US011219295B2

(12) United States Patent
Morrow

(10) Patent No.: US 11,219,295 B2
(45) Date of Patent: Jan. 11, 2022

(54) TRAVEL SIZE DEODORANT DISPENSER WITH IMPROVED CAP

(71) Applicant: Richard P. Morrow, Norwalk, CT (US)

(72) Inventor: Richard P. Morrow, Norwalk, CT (US)

( * ) Notice: Subject to any disclaimer, the term of this patent is extended or adjusted under 35 U.S.C. 154(b) by 96 days.

(21) Appl. No.: 16/719,736

(22) Filed: Dec. 18, 2019

(65) Prior Publication Data

US 2020/0163441 A1 May 28, 2020

Related U.S. Application Data

(63) Continuation-in-part of application No. 15/965,171, filed on Apr. 27, 2018, now abandoned.

(51) Int. Cl.
*A45D 40/26* (2006.01)
*A45D 40/00* (2006.01)

(52) U.S. Cl.
CPC ..... *A45D 40/26* (2013.01); *A45D 40/0087* (2013.01)

(58) Field of Classification Search
CPC .... A45D 40/26; A45D 40/087; A45D 40/081; A45D 40/00; A45D 40/12; A45D 40/18; A45D 40/22; A45D 40/221; A45D 40/222; A45D 2040/0006; A45D 2040/0012; A45D 2040/0025; A45D 2040/22
USPC ..... 401/59, 58, 62, 86, 87; 215/270, 317, 215/321, 341, 353
See application file for complete search history.

(56) References Cited

U.S. PATENT DOCUMENTS 1,346,257 A * 7/1920 Robinson ..... B65D 53/02 215/352
3,131,410 A * 5/1964 Anderson ..... A47L 23/05 15/244.1
4,519,795 A * 5/1985 Hitchcock, Jr. ..... A61M 35/003 401/132
4,701,168 A * 10/1987 Gammons ..... A61M 35/006 604/1
5,615,440 A * 4/1997 Cowan ..... A47L 23/05 15/104.94
5,738,123 A * 4/1998 Szekely ..... A45D 40/0087 132/318

* cited by examiner

*Primary Examiner* — David J Walczak
(74) *Attorney, Agent, or Firm* — Handal & Morofsky LLC; Anthony H. Handal; Izick Vizel

(57) ABSTRACT

A device for application of a gel or solid substance to a human body surface comprised of an applicator portion to which gel or solid deodorant is secured and which is coupled to a handle portion. The applicator portion is sized to accommodate a single application of deodorant in a compact format while the handle portion is sized to be grasped between the fingers and thumb of the human hand. The handle portion comprises a moveable connecting point allowing the handle portion to traverse between a storage position and a gripping position during use. The applicator portion is integrally formed with said handle portion.

14 Claims, 35 Drawing Sheets

TRAVEL SIZE DEODORANT DISPENSER WITH IMPROVED CAP

CROSS REFERENCE TO RELATED APPLICATIONS

This application is a continuation-in-part of U.S. patent application Ser. No. 15/965,171 filed Apr. 27, 2018, entitled Travel Size Deodorant Dispenser, the priority of which is hereby claimed. The disclosure of the aforementioned application is hereby incorporated by reference.

TECHNICAL FIELD

The invention relates to apparatus and methods for the delivery of deodorant to the surface of the skin of a human user.

STATEMENT REGARDING FEDERALLY SPONSORED RESEARCH OR DEVELOPMENT (Not applicable)

BACKGROUND OF THE INVENTION

Today, people are exceedingly busy in attending to business matters and often have to rush between multiple appointments. Often, this does not leave much time for the luxury of returning home to freshen up. Accordingly, such products are of increasing importance.

Additionally, a high-paced, mobile lifestyle, involving such things as airline flights, road trips and the like, does not lend itself well to carrying large hygiene product containers, such as a conventional deodorant product, which can open, and under certain circumstances, spill while they are inside bags and briefcases. Therefore, a need exists for a small, single use deodorant applicator which can be easily concealed, even in a small pocket, yet safe for transport due to an individually sealed, portable design.

SUMMARY OF THE INVENTION

In accordance with the invention, an apparatus for the delivery of deodorant to the surface of the human body is provided. It comprises an applicator portion to which is secured a gel or solid deodorant and which is coupled to a handle portion. The applicator portion is sized to accommodate a single application of deodorant in a compact format while the handle portion is sized to be grasped between the fingers and thumb of a human hand. The handle portion comprises a flexible connecting point allowing the handle portion to traverse between a storage position and a gripping position during use.

The invention comprises an apparatus for the application of a gel or solid deodorant substance or other personal hygiene or topical substance to the surface of a human body. In accordance with the invention, a base comprises an applicator portion. The applicator portion has a deodorant support side, a gripping portion, and a deodorant substance secured to the applicator portion of the base. The base and deodorant substance form the applicator and an enclosure defining a compartment houses the base and the deodorant substance.

The applicator portion of the base comprises a matrix of recesses to which the deodorant substance is affixed. The matrix of recesses defines an array of narrow elongated contours at least some of which extend at least partially around one or more of others of the narrow elongated contours. Each of the narrow elongated contours defines a recess defined by facing sidewalls which extend at an angle with respect to the deodorant support side and face the sidewalls engaging the deodorant substance. The handle is coupled to the gripping portion of the base. The enclosure comprises a plastic film. The handle comprises a rigid grip dimensioned to be grasped between the fingers and thumb of a human hand. A mounting member coupled to the base and rotatably supporting the rigid grip enables the rigid grip to move between a storage position and a gripping position. The mounting member of the apparatus is mounted on the base by mounting pins allowing the flexible mounting member to rotate around the mounting pins in an arc.

The handle of the apparatus may comprise a cloth member comprising a gripping end protruding from the gripping portion of the base and dimensioned to be grasped between the fingers and thumb of a human hand and a mounting end coupled to the gripping portion of the base.

The handle may also comprise two gripping members protruding from the base. The gripping members define a finger hole passing through the gripping member. The hole is sized to allow a finger or thumb of a human hand to be inserted within the finger hole. The gripping members comprise a flexible mounting member coupled to the base which allow the gripping members to traverse between a storage position and a gripping position. The base and handle are made of plastic injection molded from a single piece of plastic.

BRIEF DESCRIPTION OF THE DRAWINGS

The operation of the invention will become apparent from the following description taken in conjunction with the drawings, in which.

DETAILED DESCRIPTION OF THE PREFERRED EMBODIMENTS

Figure 1A:
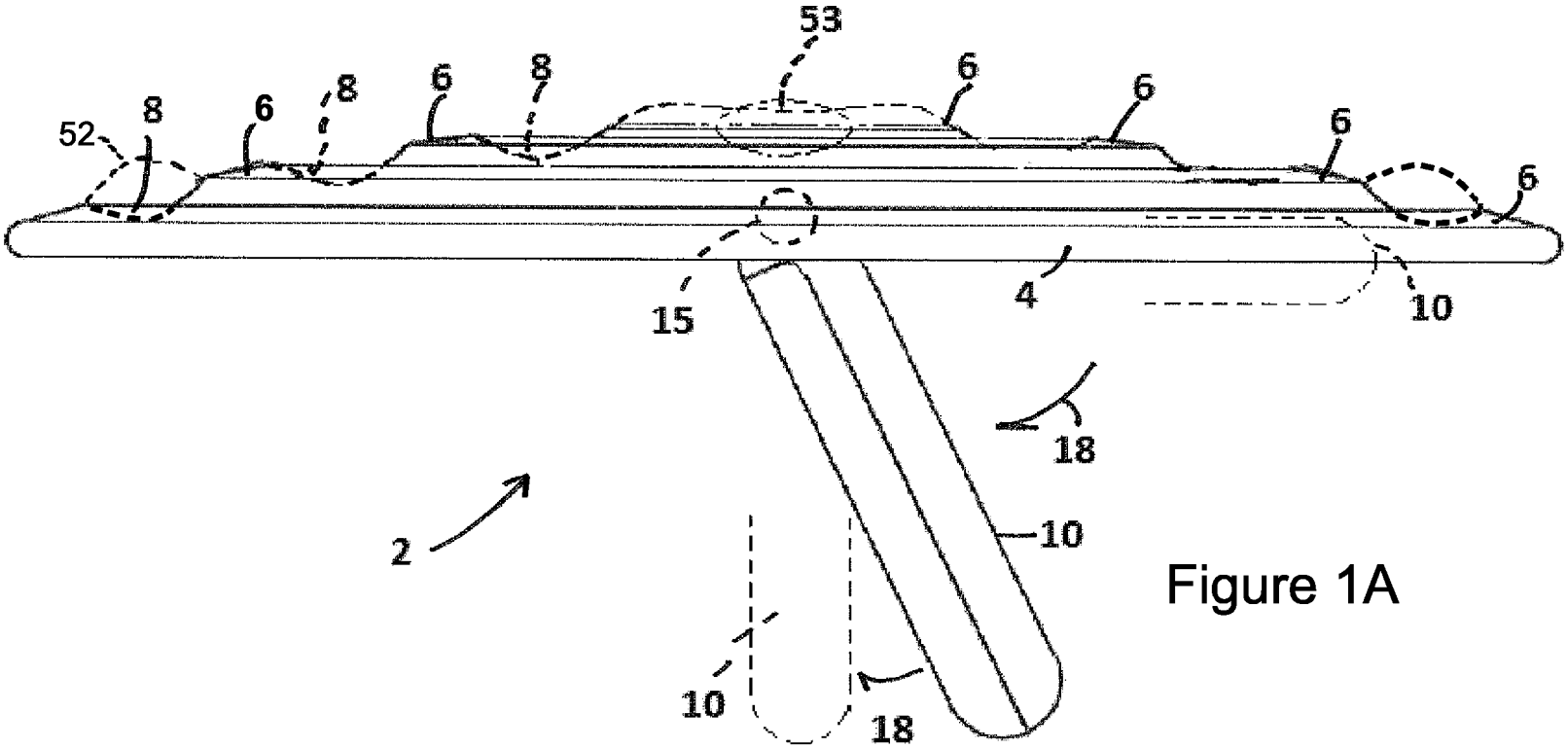
FIG. 1*a* is a side view outlining the basic elements of the invention in which the applicator portion and handle portion may be understood.

Referring to FIG. 1*a*, an overview of a single-use deodorant applicator may be understood. The single-use deodorant applicator 2 comprises a circular base 4 composed of plastic in accordance with a preferred embodiment, or, alternatively, metal. Base 4 is rigid and functions as a foundation upon which the rest of the device is constructed. The top of circular base 4 comprises a series of raised rings 6 as well as corresponding circular channels 8. Raised rings 6 and circular channels 8 are shaped and spaced in such a way that deodorant, in either gel or solid form, can be affixed to base 4 with the deodorant utilizing raised rings 6 and circular channels 8 as an adherence surface. A plastic or metal handle 10 is coupled to the underside of base 4 such that handle 10 can swivel out from a position lying flat against base 4 (as illustrated in phantom lines), to a position perpendicular or nearly perpendicular to the bottom surface of base 4 for use, or swivel in, parallel to the bottom surface of base 4 for storage.

Figure 1B:
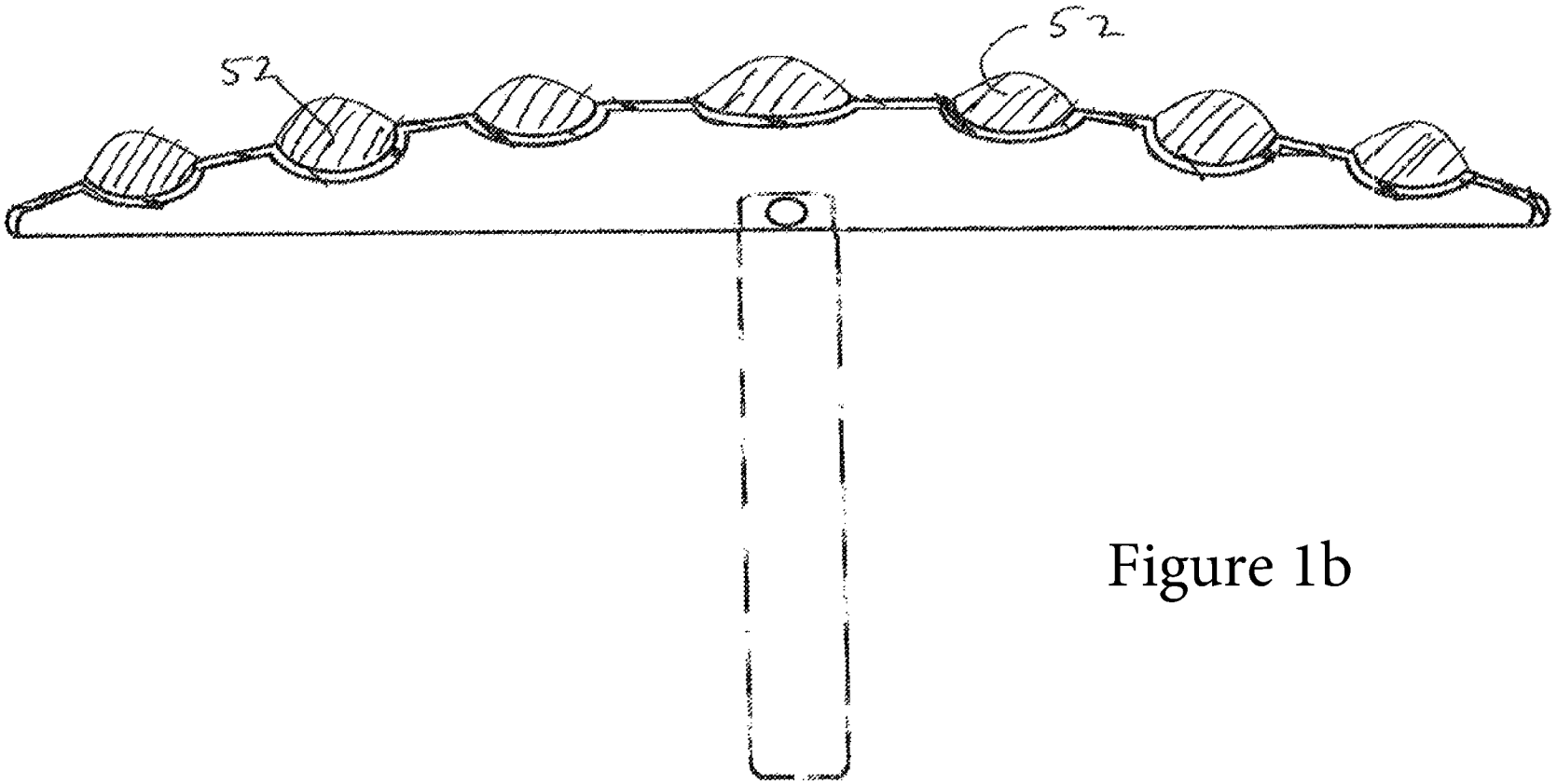
FIG. 1*b* is a cross-sectional view of the support base and supported deodorant material along lines 1*b*-1*b* of FIG. 3 corresponding to a cross-sectional view defined by the intersection of a plane perpendicular to the plane roughly defined by the support and a plane perpendicular to and passing through the center of the support.

FIG. 1*b* illustrates the placement of deodorant material 52 in channels 8 in the form of rings of deodorant material. It will be understood from the figures that successive rings are positioned at different heights from the bottom of base 4. The outermost rings of deodorant material 52 are relatively low and the central deposition of deodorant material 53 is in the highest position. Accordingly, together rings of deodorant material 52 and the central circular deposition of deodorant material 53 generally defined a convex or domed configuration.

Figure 2:
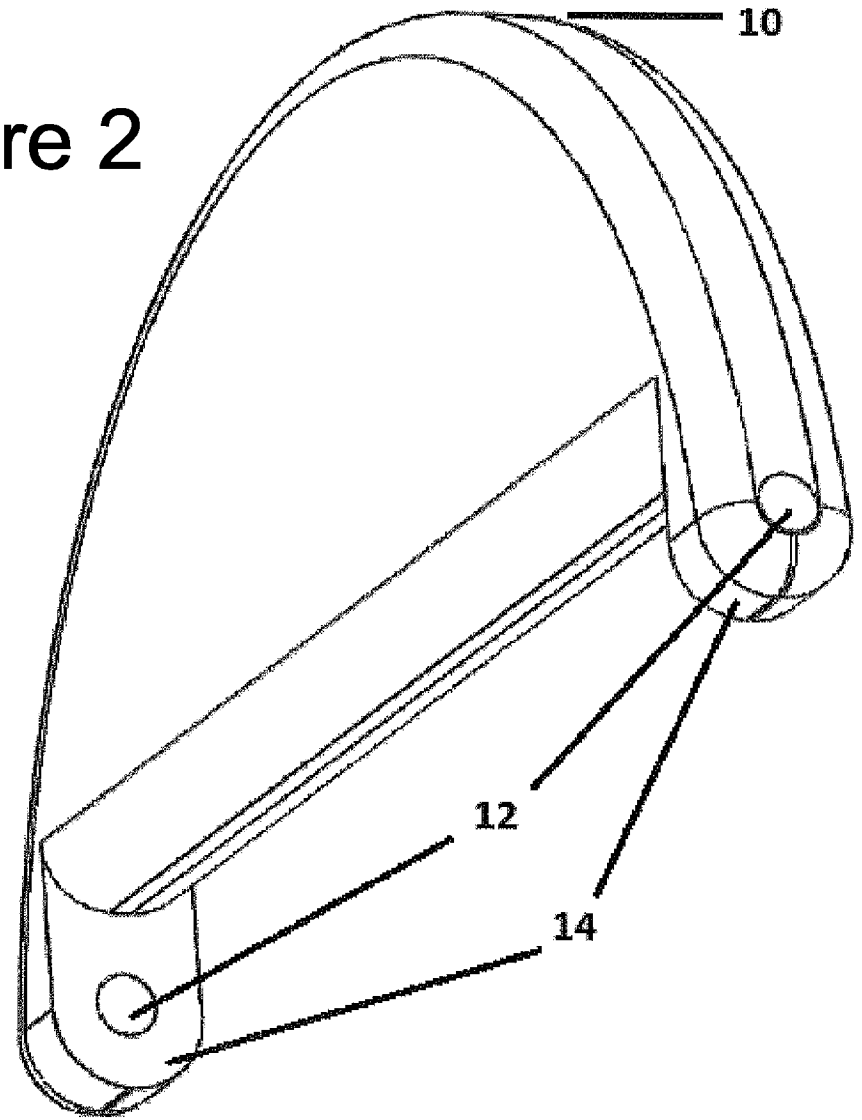
FIG. 2 is a diagram of a rigid handle system embodiment of a handle portion of the invention.

Referring to FIG. 2, the construction of handle 10, and how handle 10 attaches to base 4, may be better understood. Handle 10 is constructed in a semi-circular shape. Handle 10 made sized such that it can fold back against base 4 without protruding. Two mounting holes 12 pass completely through mounting arms 14, which extend past base 4 on either side of the attaching end of handle 10. The mounting arms 14 and handle 10 are formed in a single injection molded plastic member, adding strength and simplicity to the design. The mounting holes 12 allow the handle 10 to be attached to base 4 of the single-use deodorant applicator through the use of mounting pins 15 (FIG. 1 *b*), which will be described in greater detail below.

Figure 3:
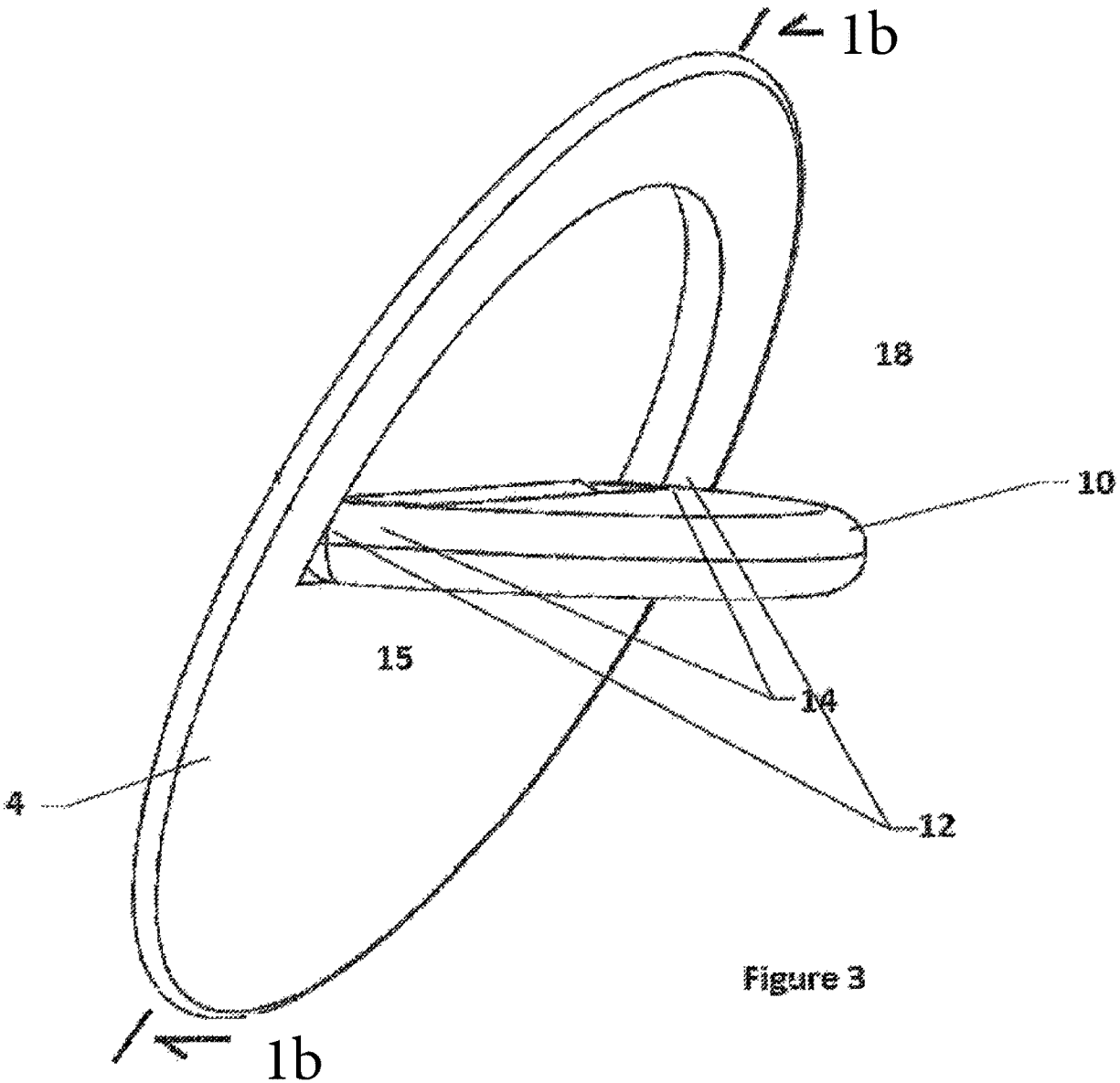
FIG. 3 is a diagram of a coupling system comprising a rigid handle system and the base of the applicator portion of the invention.

Referring to FIG. 3, a connection assembly attaching handle 10 to base 4 may be understood in greater detail. The handle 10 connects to base 4 such that handle 10 can be quickly snapped into place during component assembly. The component assembly process involves aligning mounting arms 14 of handle 10 perpendicular to the bottom of base 4 such that mounting holes 12 of mounting arms 14 are positioned just below a pair of mounting pins 15 protruding from base 4. The mounting pins 16 protrude from base 4 such that they are always in line with holes 12 in mounting arms 14, when properly mounted inside mounting holes 12. The mounting pins 15 are positioned such that it is possible for handle 10 to traverse a semi-circular arc defined in the direction of arrows 18, thus allowing the orientation of handle 10 to traverse such arc from a flat starting position against the bottom of base 4 to a finishing position which is perpendicular to the bottom of base 4. Deodorant material 52 (FIG. 1*a*) of conventional design is deposited in circular channels 8.

Figure 4:
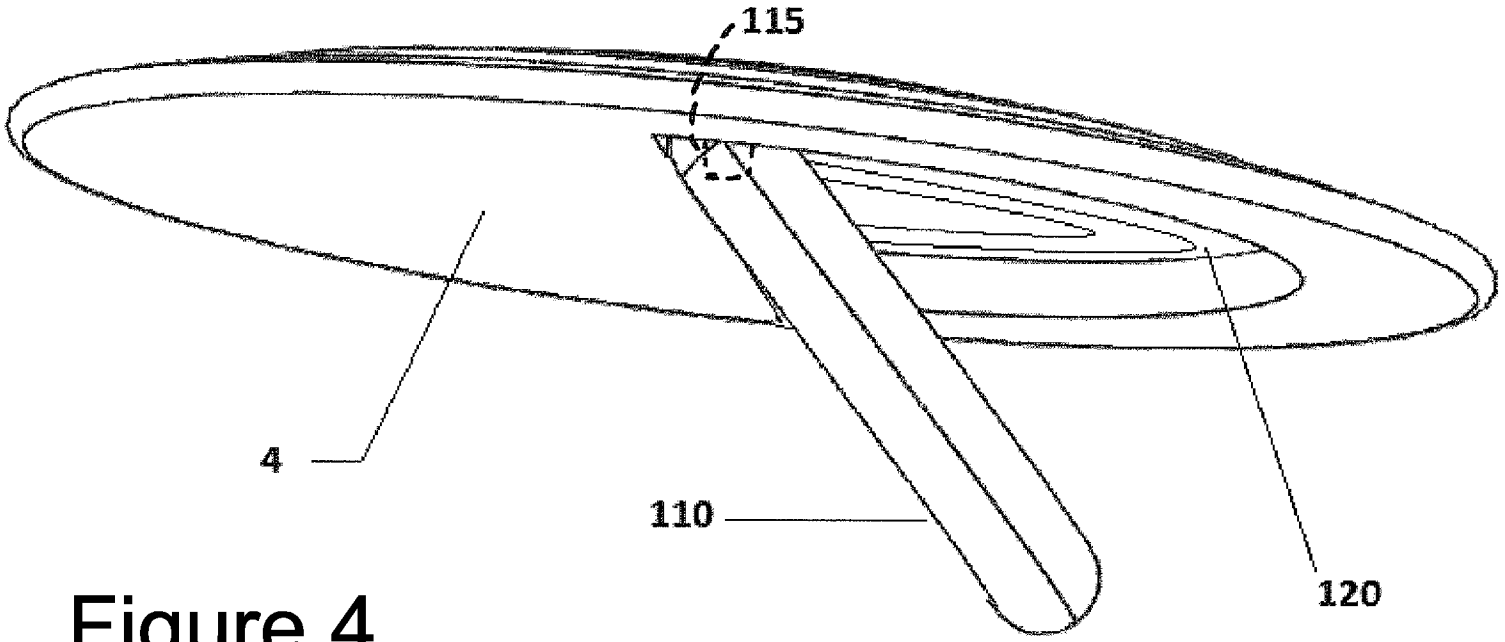
FIG. 4 is a diagram of an alternate mounting method of a rigid handle system coupled to the base of the applicator portion of the invention.

Referring to FIG. 4, an alternate mounting method for handle 110 may be understood. Once again, handle 110 is attached to base 104 similarly to handle 10 (FIG. 3) thus allowing handle 110 to traverse in an arc from a flat position against base 104 to an extended position which is perpendicular to base 104. The mounting pins 115 are coupled to base 104 and are located inside a recess 120 on the bottom of base 104, thus allowing handle 110 to fold inside base 104 for compact storage with minimal or no protrusion from base 104. The recess 120 is shaped to match the shape of handle 110 such that handle 110 fits snugly inside recess 120 without sticking such that handle 110 may be easily extended along the arc defined by the movement of handle 110, as it may be moved by the use of, for example, a human finger.

Figure 5:
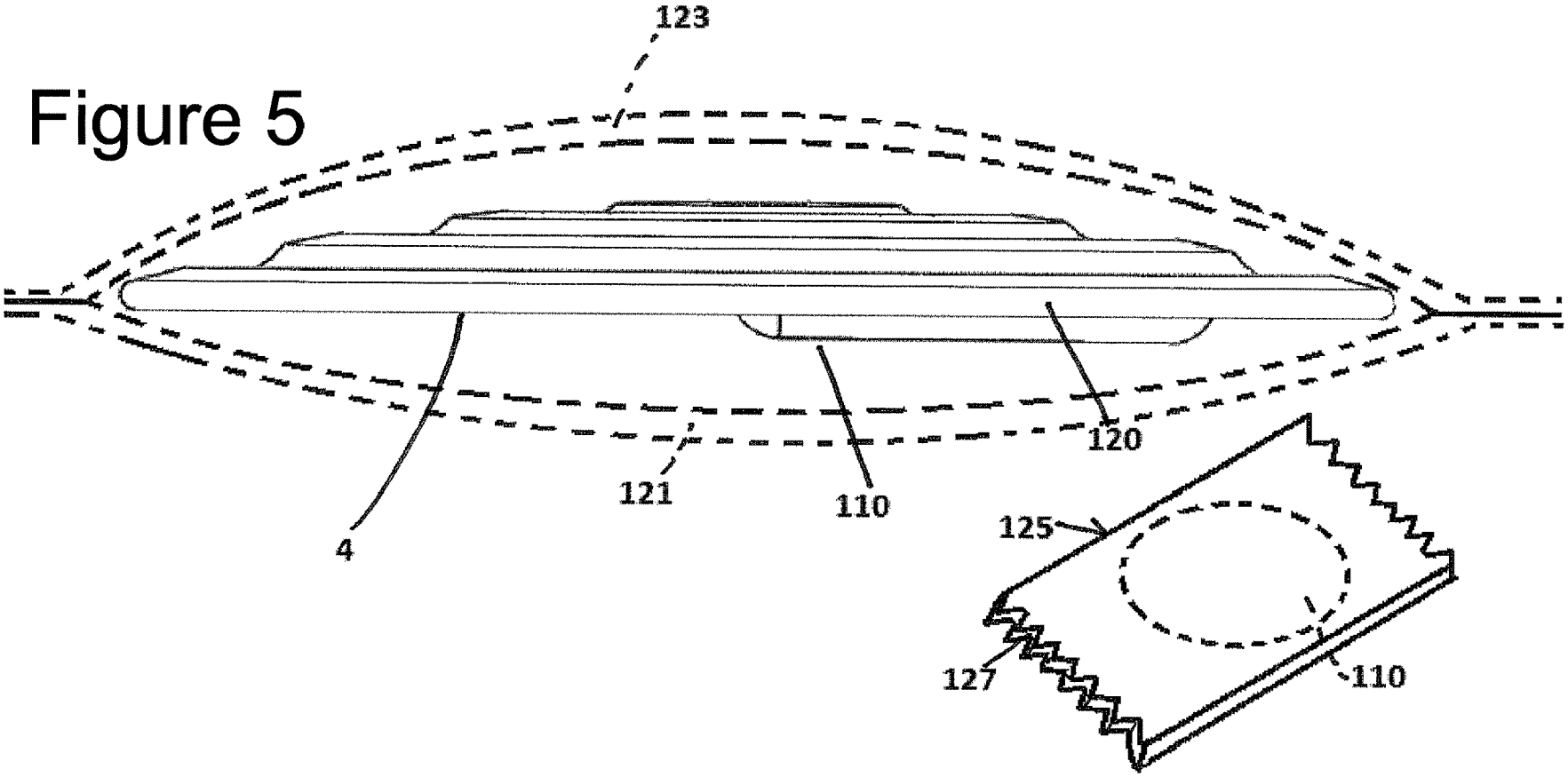
FIG. 5 is a diagram of a possible storage configuration for the invention in which a rigid handle system is stowed into a recess in the underside of the base of the applicator portion of the invention.

Referring to FIG. 5, it may be understood how handle 110 fits snugly inside recession 120 of base 104 when handle 110 is in a closed position. In this diagram, it is shown how handle 110 protrudes slightly from recess 120 in the bottom of base 104 such that a finger may make easier contact with handle 110. The configuration diagramed in FIG. 5 allows for a larger contact surface between handle 110 and a human finger while still providing a thin profile for compact storage. If no protrusion is desired, handle 110 may made thinner.

Also referring to FIG. 5, an optional storage packet may be used to contain the apparatus. Such storage packets may be a conventional form, for example, similar to those used to house condiments such as ketchup and mustard. In accordance with the invention, such a storage packet may be formed in a conventional manner, for example being formed by a pair of facing planar film members. More particularly, a container may be formed by a planar bottom layer 121 and a planar top layer 123. Planar bottom layer 121 and planar top layer 123 may be made of a polymer, such as a simple plastic film as is used to house ketchup. Alternatively, metallized polymer layers may also be employed. In accordance with the invention, it is contemplated that planar bottom layer 121 and planar top layer 123 would have a thickness in the range of 2-7 thousandths of an inch.

In the case of a simple polymer layer of the type used to house ketchup in individual single servings, planar bottom layer 121 and a planar top layer 123 may be formed into a packet by being heat-sealed around their edges 125 (FIG. 5*a*). As is apparent from the figures, planar bottom layer 121 and planar top layer 123 are substantially the same size and larger than the inventive applicator 110. Accordingly, planar bottom layer 121 and planar top layer 123 extend beyond the edge of both the length and width of the applicator 110. The peripheral portions of planar bottom layer 121 and a planar top layer 123 are fused together, for example, using heat around the edge of the apparatus to form an airtight, single-use container similar to a ketchup packet. The result is a sealed unit 125 containing applicator 110. Sealed unit 125 includes serrations 127 in a manner typical of such packets.

It is noted that while the use of such a package is illustrated only in FIG. 5, it may be understood this packet can be used to house any of the other variations of the inventive apparatus as illustrated in the figures herein.

In accordance with the invention, it is contemplated that a plurality of applicators 110 would be contained each in its own container 123, perhaps packaged in a larger box containing a half-dozen or several dozen packaged applicators. When it is desired to use one of these devices to apply deodorant, the package is split between the serrations 127 using the fingernails, torn open and the deodorant applicator 110 is removed and used as described herein.

Figure 6:
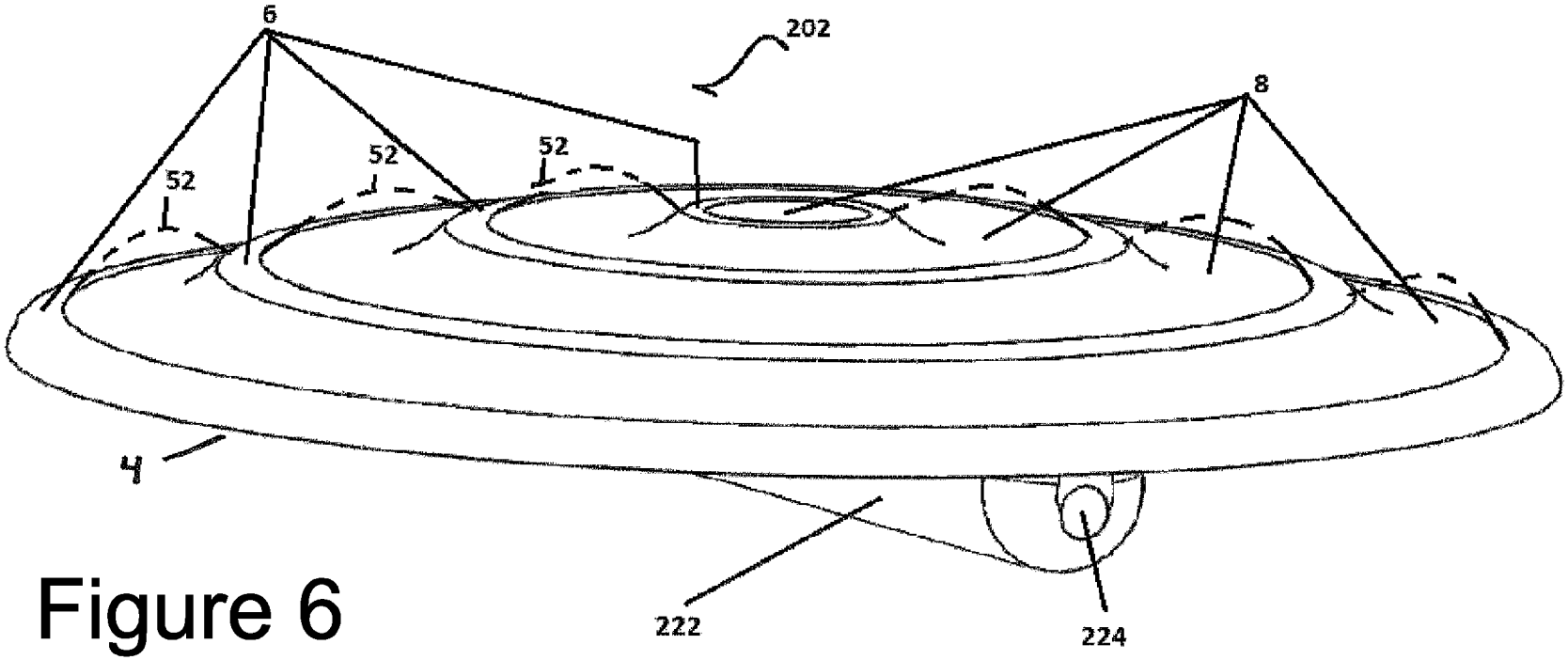
FIG. 6 is a diagram of an alternate mounting configuration for a handle portion of the invention.

Referring to FIG. 6, an alternate mounting configuration for handle 10 may be understood. A cylindrical mounting protrusion 222 extends from the bottom of base 4 such that it is possible to align mounting holes 12 of mounting arms 14 with mounting pin 224 of mounting protrusion 222. The mounting pin 224 along the length of mounting protrusion 222, perpendicular to the circular faces of the cylinder and, therefore, parallel to the bottom of the base 4. When the mounting holes 12 of the mounting arms 14 are properly aligned with the mounting hole 14 of the mounting protrusion 222, handle 10 rotates on pins 224. Thus, handle 10 may easily be snapped into place, similar to the process described with respect to FIG. 3, and may further rotate freely after being snapped into place.

Also referring to FIG. 6, the circular ring system of ridges and channels involved in the mounting of gel or solid deodorant may be understood. The raised rings 6 and circular channels 8 are all formed from the same plastic member that comprises base 4 during the fabrication process of, for example, injection molding. Furthermore, the mounting protrusion 222 can be formed from the same plastic mold as well during the fabrication process with the mounting pin 224 B. As a result of the fabrication process, the raised circular rings 6 and circular channels 8 form a mounting surface for a gel or solid deodorant 52 such that the tops of the channels 8 are nearly slanted extending from but not quite perpendicular to the base 4, thus providing sufficient friction to hold a gel or solid deodorant in place. Because the inner rings 6 and channels 8 protrude higher from the base 4 than the outer rings 6 and channels 8, it is possible for the single-use deodorant applicator 202 to conform to various human body surfaces more easily.

Figure 7:
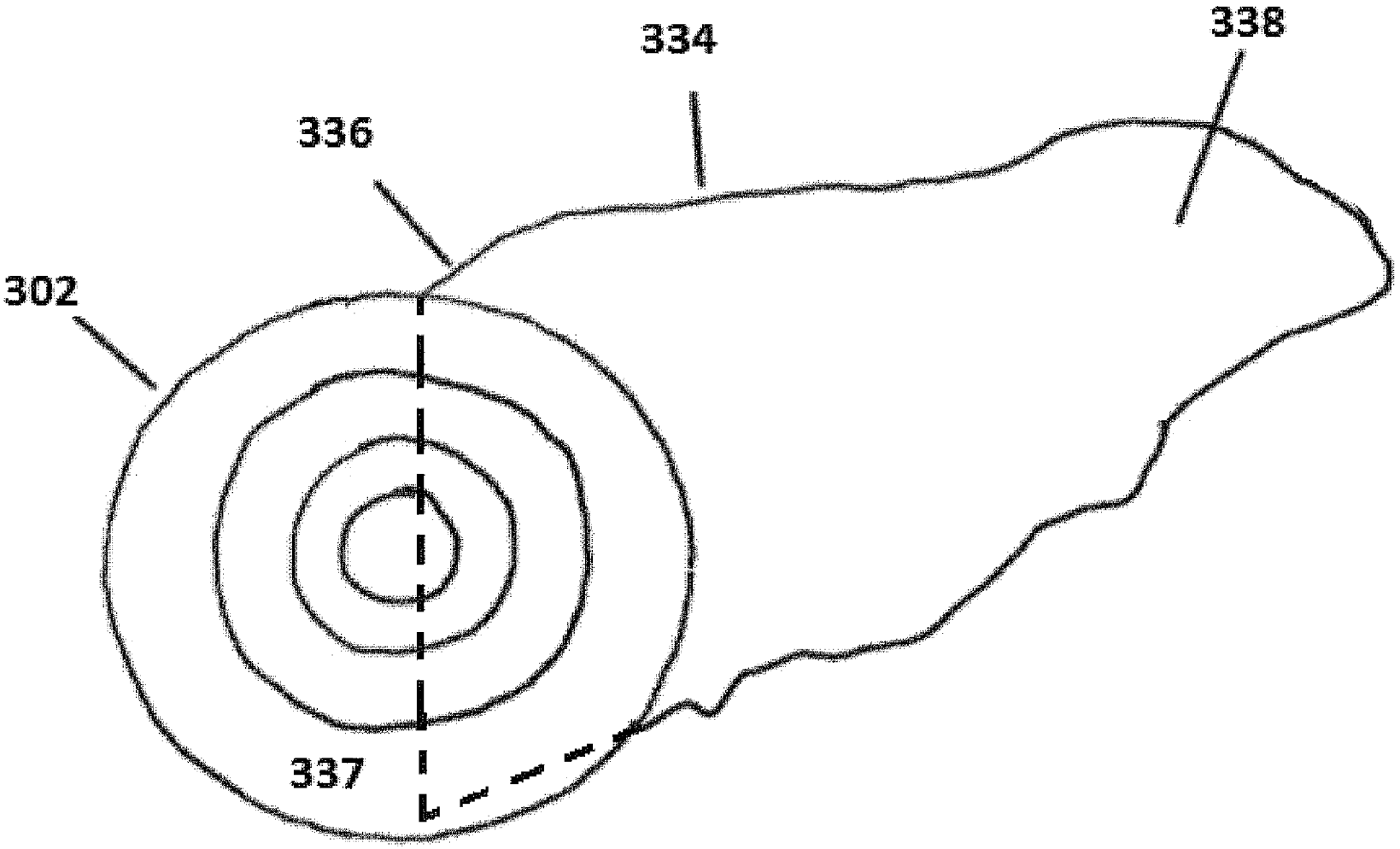
FIG. 7 is a diagram of another alternate cloth handle portion of the invention.

Referring to FIG. 7, an alternate handle system 334 may be understood. In this alternate handle system, a flexible or semi-rigid handle 34 is cut to shape from a sheet of cloth or plastic. The handle 334 comprises an attachment end 336 on one side and a gripping end 338 on the other side. The attachment end 336 is affixed along a joinder line 337 to the bottom of the single-use deodorant applicator 302 using some form of adhesive such as glue or tape. The gripping end 338 protrudes from the side of the single-use deodorant applicator 302 to a sufficient distance such that the gripping end 338 may be easily grasped by the fingers of a human hand. The handle 334 is sufficiently thin to allow for compact packaging. Accordingly handle 334 can be folded behind the single-use deodorant applicator 302 for compact packaging.

Figure 8:
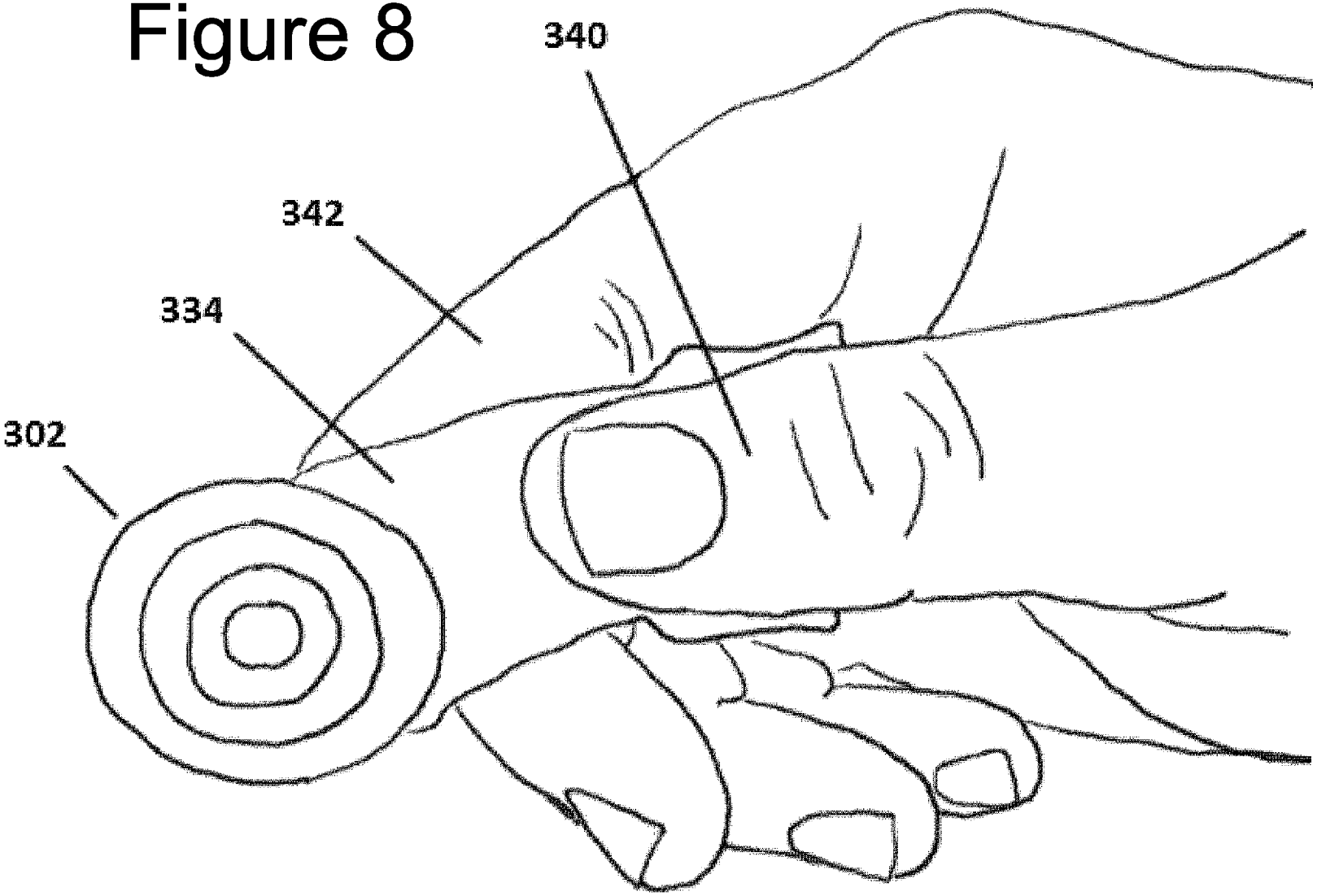
FIG. 8 illustrates the use of the above mentioned alternate cloth handle portion of the invention.

Referring to FIG. 8, the use of the alternate handle system 334 may be understood. As mentioned above, the gripping end 338 of the handle 334 protrudes from the side of the single-use deodorant applicator 302. This allows the fingers of a human hand to easily grasp the handle 334 between them with thumb 340 pressing against the top side of handle 334 and finger 342 pressing against the bottom side of handle 334. This method allows finger 342 to act as a guide for the single-use deodorant applicator 302 while deodorant is being applied to the human body by providing moderate pressure to rub the top surface of the single-use deodorant applicator 302 against the skin surface to which the user wishes to apply deodorant.

Figure 9:
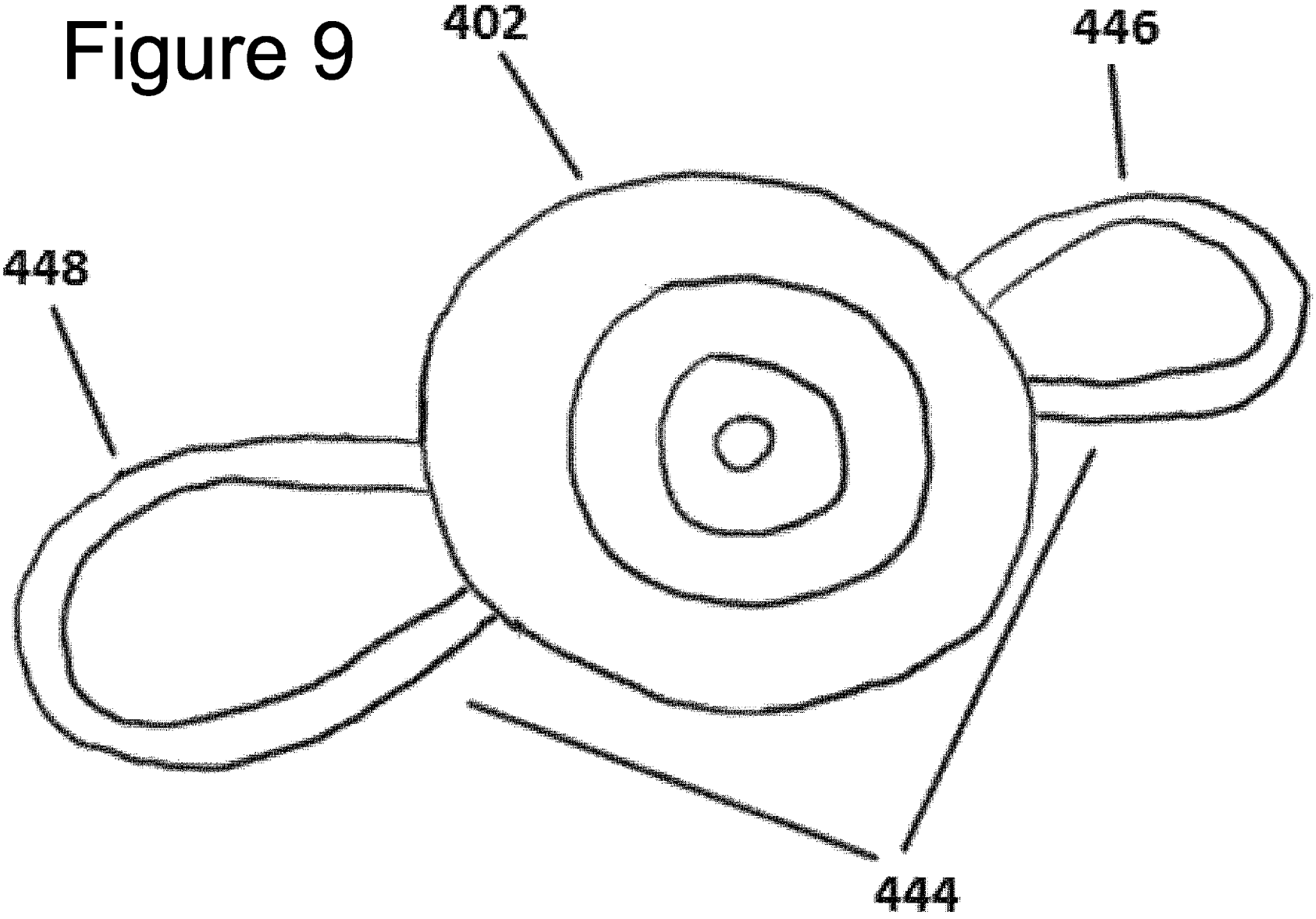
FIG. 9 is a diagram of yet another alternate handle portion comprising a pair of loops.

Referring to FIG. 9, an alternate handle system 444 may be understood. The handle system 444 comprises two plastic loops, loop 446 and loop 448, which are made from the same plastic material of which the single-use deodorant applicator 402 is made. This means that no special attachment system is required. Instead, the handle system 444 is formed at the same time as the single-use deodorant applicator 402 in a single molding or stamping process. This eliminates the need for complicated manual assembly while allowing for many instances of the single-use deodorant applicator 402 to be created simultaneously, in accordance with the manufacturing process to be described below. Loop 446 and loop 448 are flexible enough to be bent backwards below the base of the single-use deodorant applicator 402 for gripping by the thumb and finger of a human hand during use.

Figure 10:
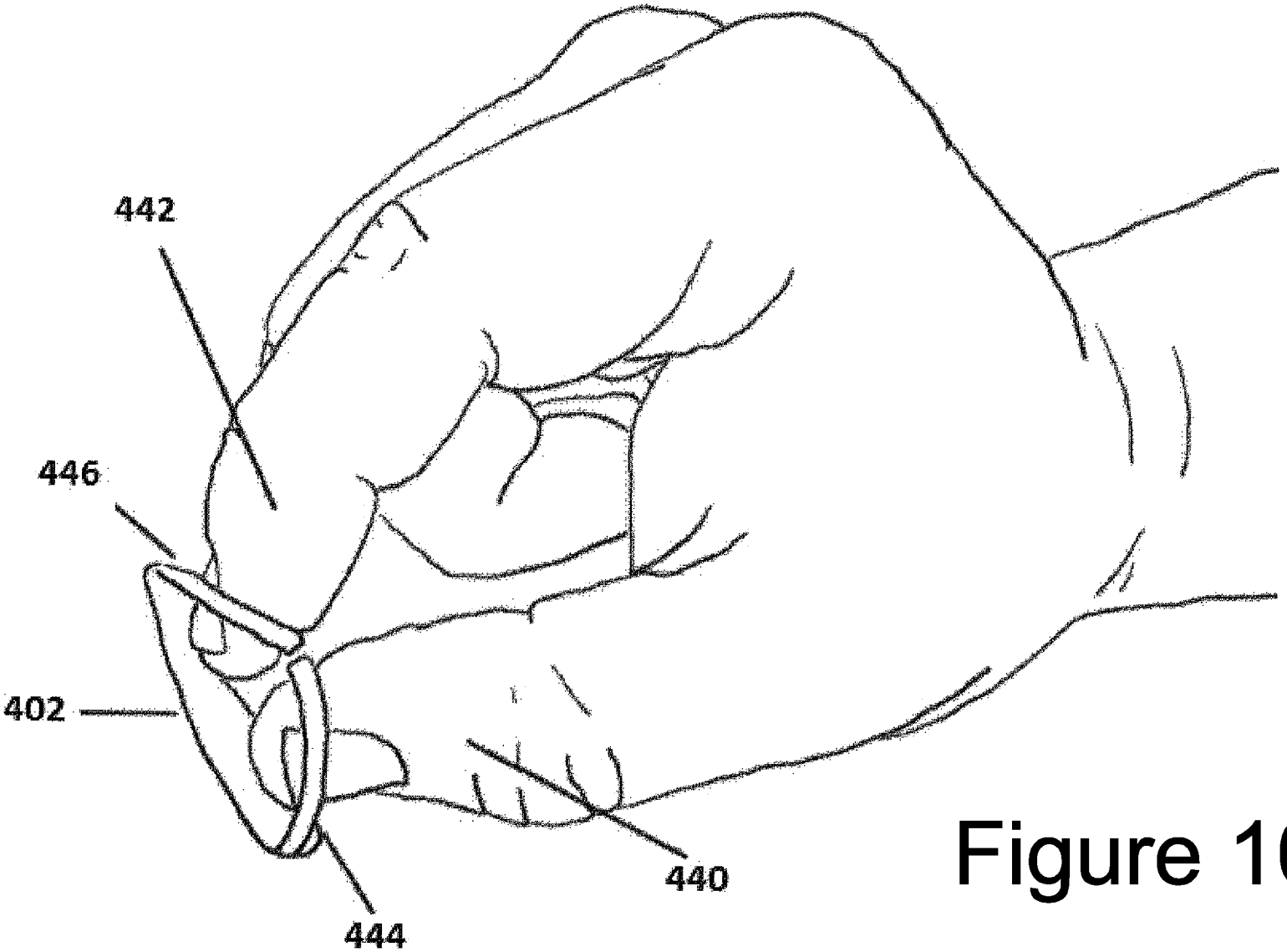
FIG. 10 shows the use of the above mentioned alternate handle portion comprising a pair of loops.

Referring to FIG. 10, the use of the alternate handle system 444 may be understood. The single-use deodorant applicator 402 is gripped by folding loop 446 and loop 448 backwards below the base of the single-use deodorant applicator 402. The thumb 440 is then inserted into the loop 446 while the finger 442 is inserted into the loop 448. The thumb 440 and the finger 442 are then pinched together, thus creating enough tension and friction to hold the single-use deodorant applicator 402 in place and allow for controlled movement during deodorant application to a human body during use.

Figure 11:
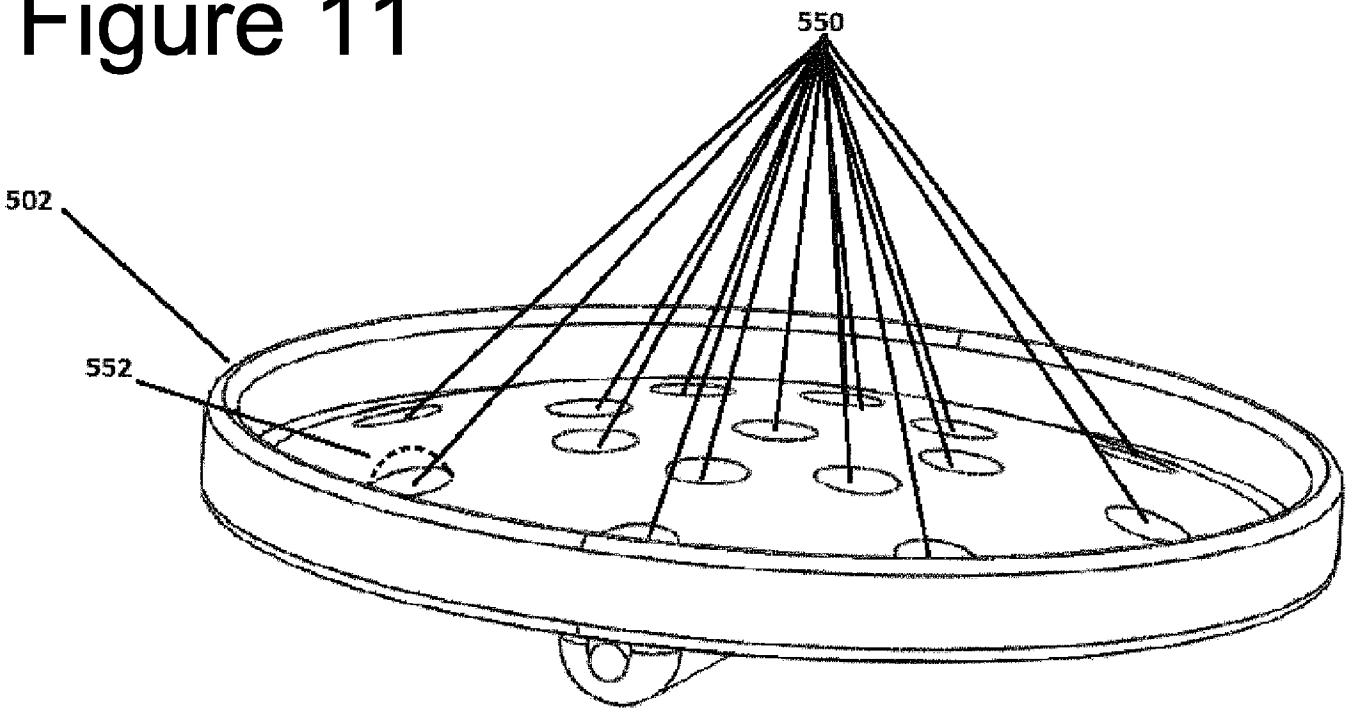
FIG. 11 is a diagram of an array of indentions across the application surface of applicator portion of the invention.

Referring to FIG. 11, a method for securing deodorant in a gel or solid form may be understood. A series of indentations 550 are distributed over the surface area of the single-use deodorant applicator 502 in which deodorant 552 in a gel or solid form may be inserted. The indentations are deep enough to provide a sufficient anchor for the deodorant.

Figure 12:
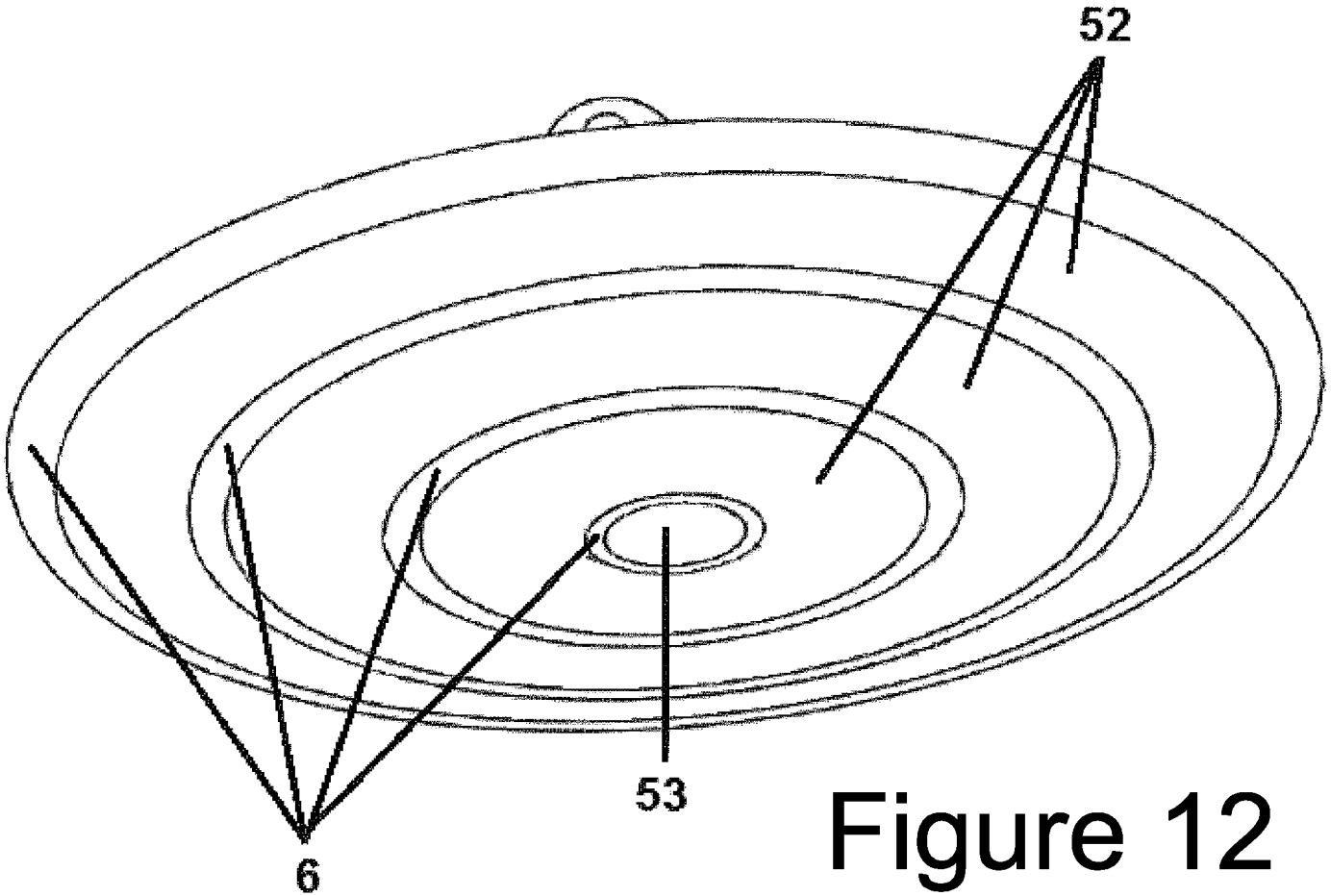
FIG. 12 is a diagram of rings of deodorant anchored between an array of raised rings on the applicator surface of the applicator portion of the invention.

Referring to FIG. 12, the anchoring of a gel or solid deodorant 52 within an array of raised rings 6 may be understood. The deodorant 52 is applied between each of the raised rings 6 such that the deodorant 52 protrudes slightly above the upper surface of the raised rings 6. During the application process, the deodorant 52 will transfer to a contacted human skin surface. Since the human skin surface is flexible, the skin can be pressed in between the raised rings 6, during application, as the vertical height of the deodorant 52 is reduced during use.

Figure 13:
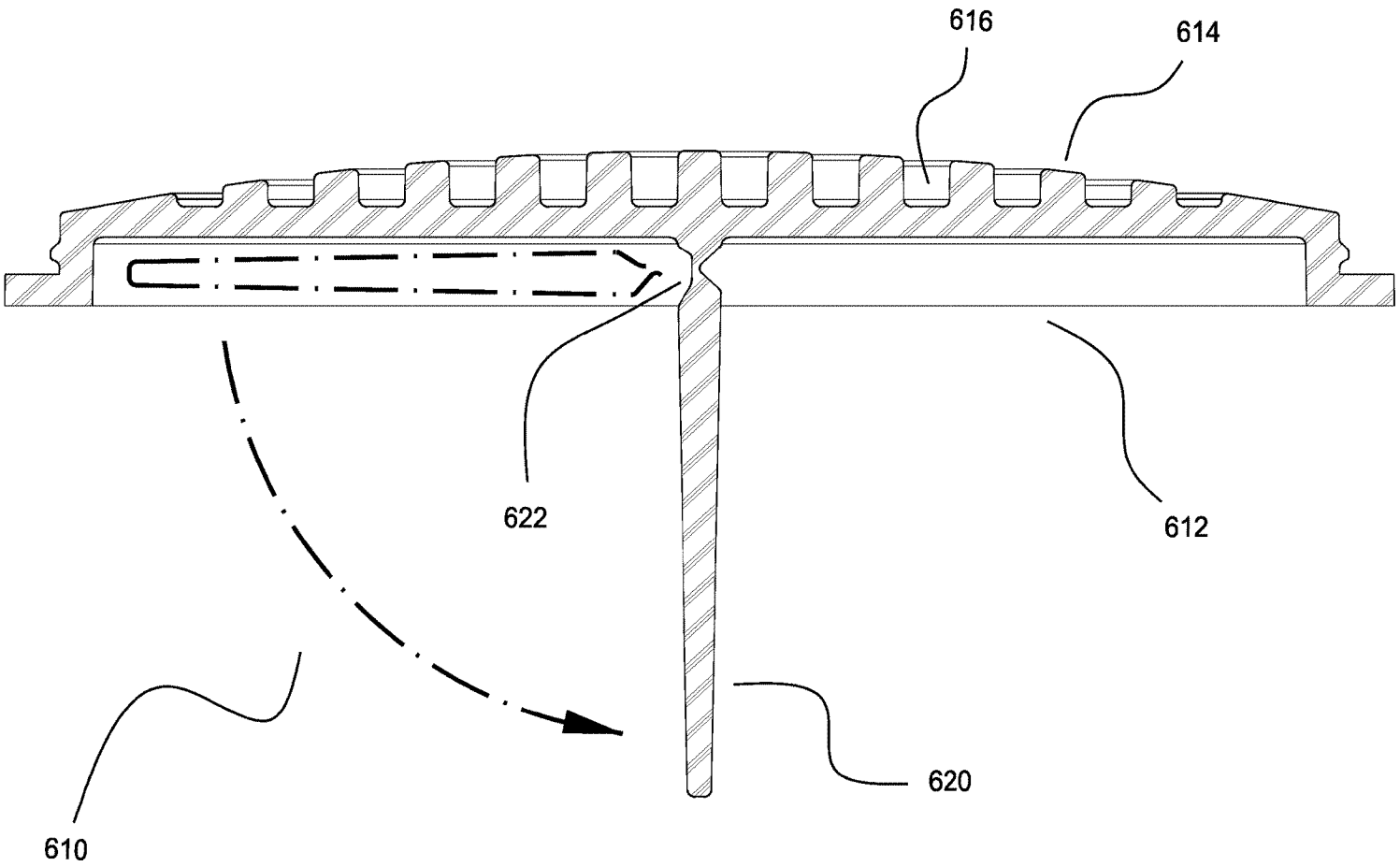
FIG. 13 is a sectional side-view of a living hinge embodiment of the applicator of the present invention with the grasping handle illustrated in solid lines with the handle moved in the direction of the arrow in the use position, and in phantom lines with the handle in the folded storage position.

Referring to FIG. 13, a sectional side-view of an alternative embodiment of the deodorant applicator 610 is shown. In accordance with the invention, it is noted that applicator 610 is manufactured in the configuration illustrated in solid lines in FIG. 13. After the same is manufactured, handle 620 is folded to the position illustrated in phantom lines after which the same may be packaged in a flat envelope like container. In use, after removal of applicator 610 from the package, handle 620 is pulled from the position illustrated in phantom lines in FIG. 13 to the position illustrated in solid lines.

Handle 620 is formed integrally with base 612 and a living hinge 622, which joins the handle to base 612. The living hinge 622 allows for the handle 620 to be folded up into the base 612 for packaging. When the user opens the package to use the deodorant applicator, the user can fold the handle 620 out of the base 612, such that the handle 620 is substantially perpendicular to the base 612, allowing the user to grasp the handle 620 and use the deodorant applicator 610. The living hinge is a more cost-effective and efficient option.

The figure also shows the raised rings 614 and corresponding circular channels 616. Raised rings 614 and circular channels 616 are shaped and spaced in such a way that deodorant can be affixed to base 612 with the deodorant utilizing raised rings 614 and circular channels 616 as an adherence surface.

The dimension of the largest rings may be in the range of about one and three-quarter inches in diameter, or about 4 centimeters. The height of the applicator may be about 0.3 inches or about 7 mm. The height of the deodorant may have a total thickness of about 3.5 mm, or about 2.5 mm in the circular channels and about 1 mm over the top of the ridge.

Figure 14:
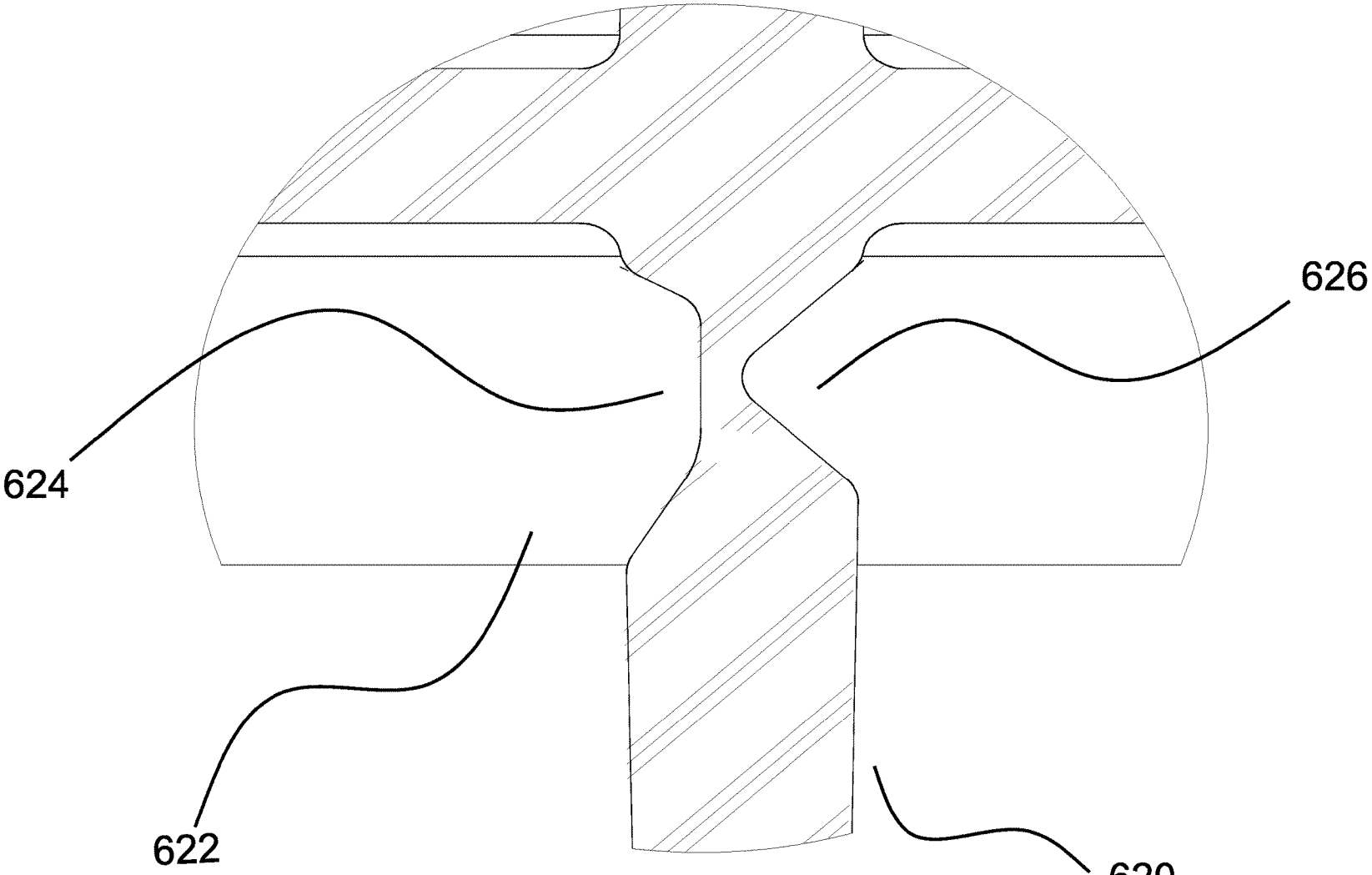
FIG. 14 is an enlarged view of the living hinge.

FIG. 14 is an enlarged view of the living hinge 622. A first surface 624 is defined on the living hinge 622. The first surface 624 has a first width. A second surface 626 is defined on the living hinge 622, directly opposite the first surface 624. The second surface 626 has a second width, which is narrower than the first width. The first width is larger to better allow the handle 620 to be bent at the living hinge 622 towards the base 612 on the side of the first surface 624. The lack of material in the location of the first surface 624 provides for the adjacent portions of the living hinge 622 and handle 620 to be compressed as the handle 620 is being folded in towards the base 612 in the direction opposite that of the arrow in FIG. 13. The narrower, second width is present in order to allow the handle 620 to fold, towards the first surface 624, in to the base 612.

Figure 15:
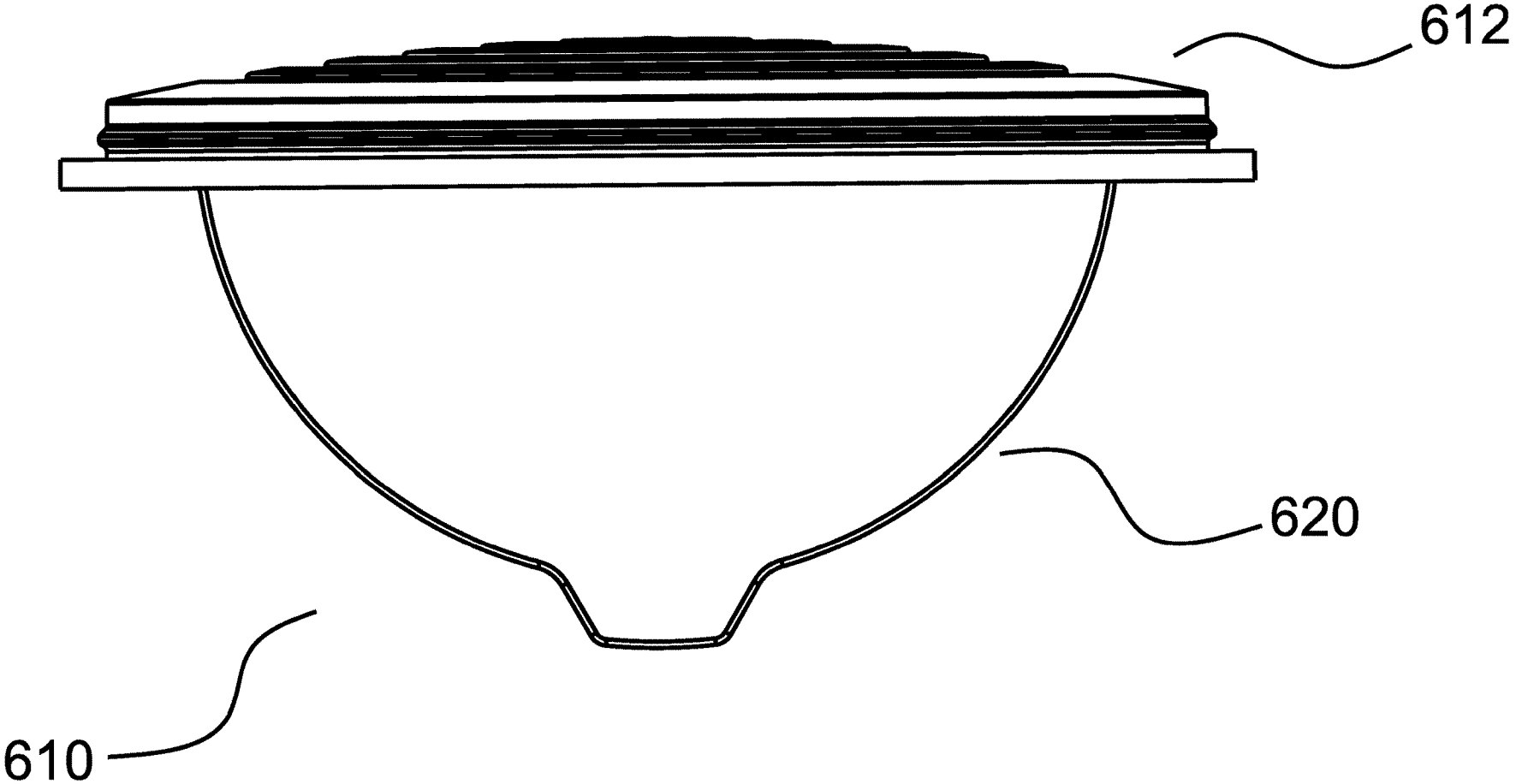
FIG. 15 is a side view of the inventive applicator.

FIG. 15 displays a side view of the living hinge applicator 610. The shape of the handle 620 can be seen from this view. The shape of the handle 620 gives the user a substantial area to grasp, giving the user a better grip while applying the deodorant.

Figure 16:
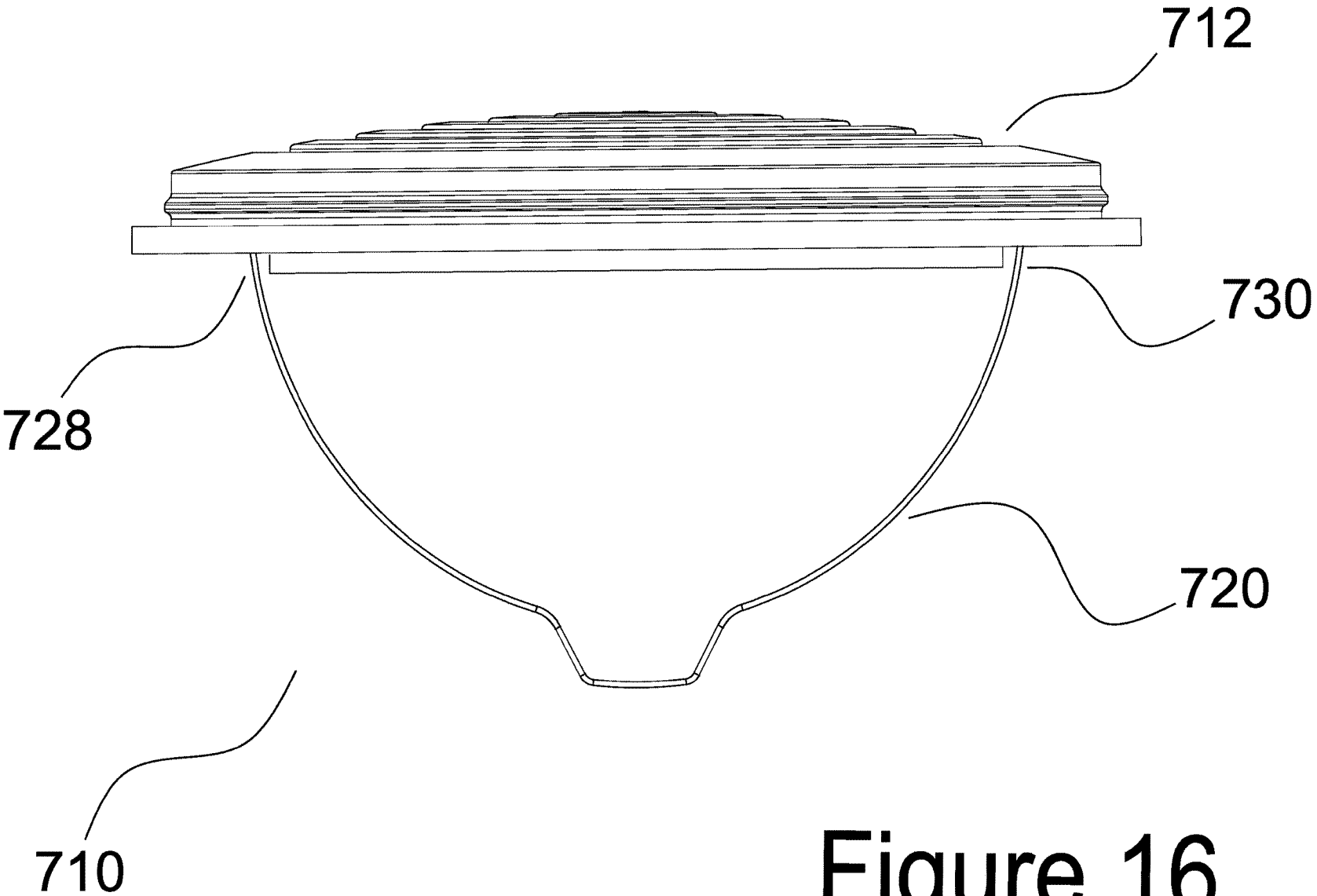
FIG. 16 is a view of an alternate living hinge embodiment of a handle of the invention with two small living hinges.

FIG. 16 displays an alternative embodiment of the inventive living hinge applicator 710. Alternative applicator 710 comprises a handle 720 and a base 712, which are substantially the same as handle 620 and base 612 of the embodiment of FIG. 13. The embodiment in FIG. 16 is essentially the same as living hinge 610 except there are two living hinges 728 and 730 which are a relatively narrow dimension. In accordance with the invention, one may have more than two living hinges.

Figure 17:
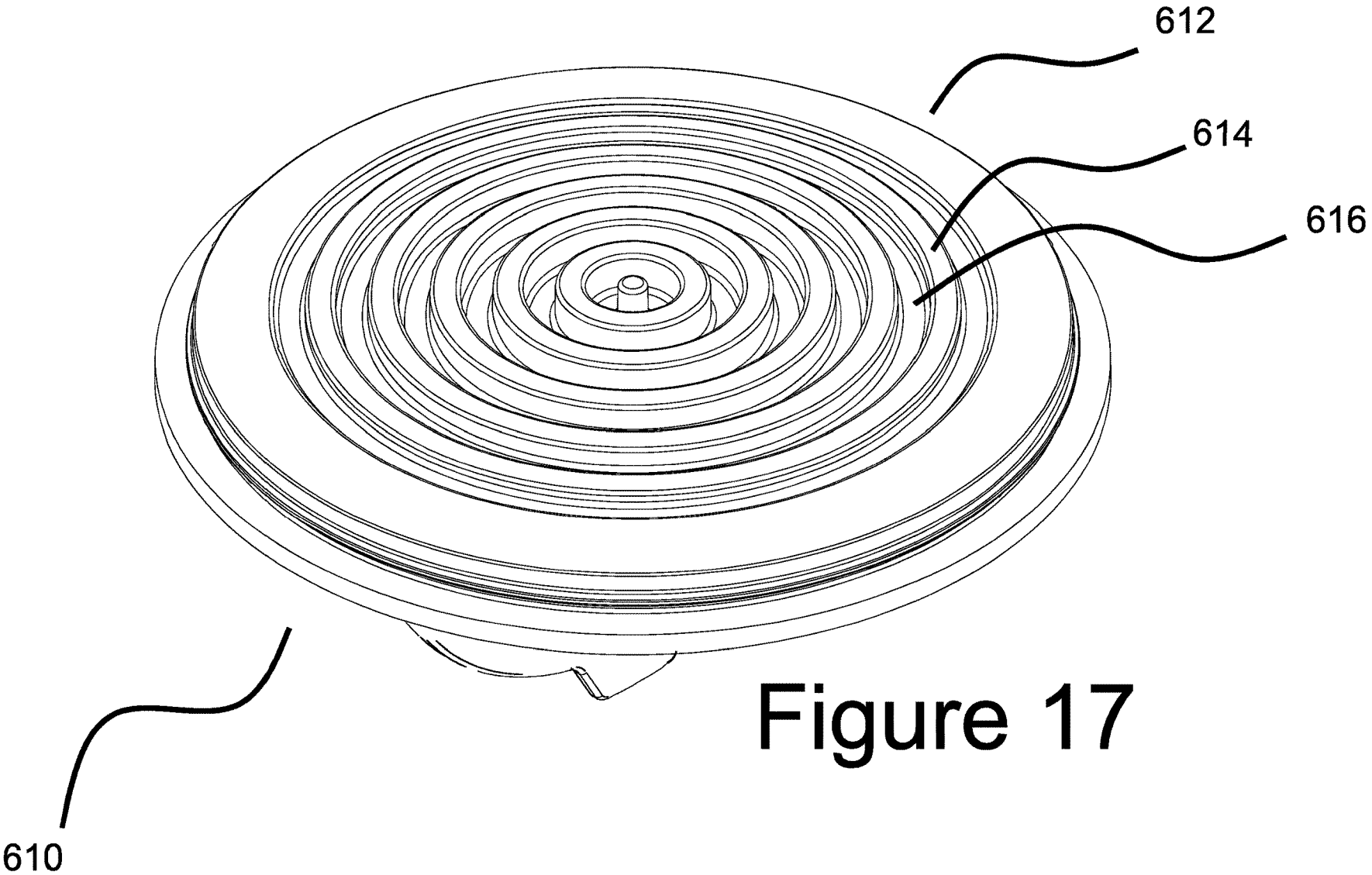
FIG. 17 is a perspective view of the inventive applicator showing the deodorant-receiving surfaces.

Returning to the embodiment of FIG. 15, FIG. 17 displays a perspective from the top of applicator 610 which is substantially the same as the top of applicator 710. This view shows the raised rings 614 and corresponding circular channels 616.

Figure 18:
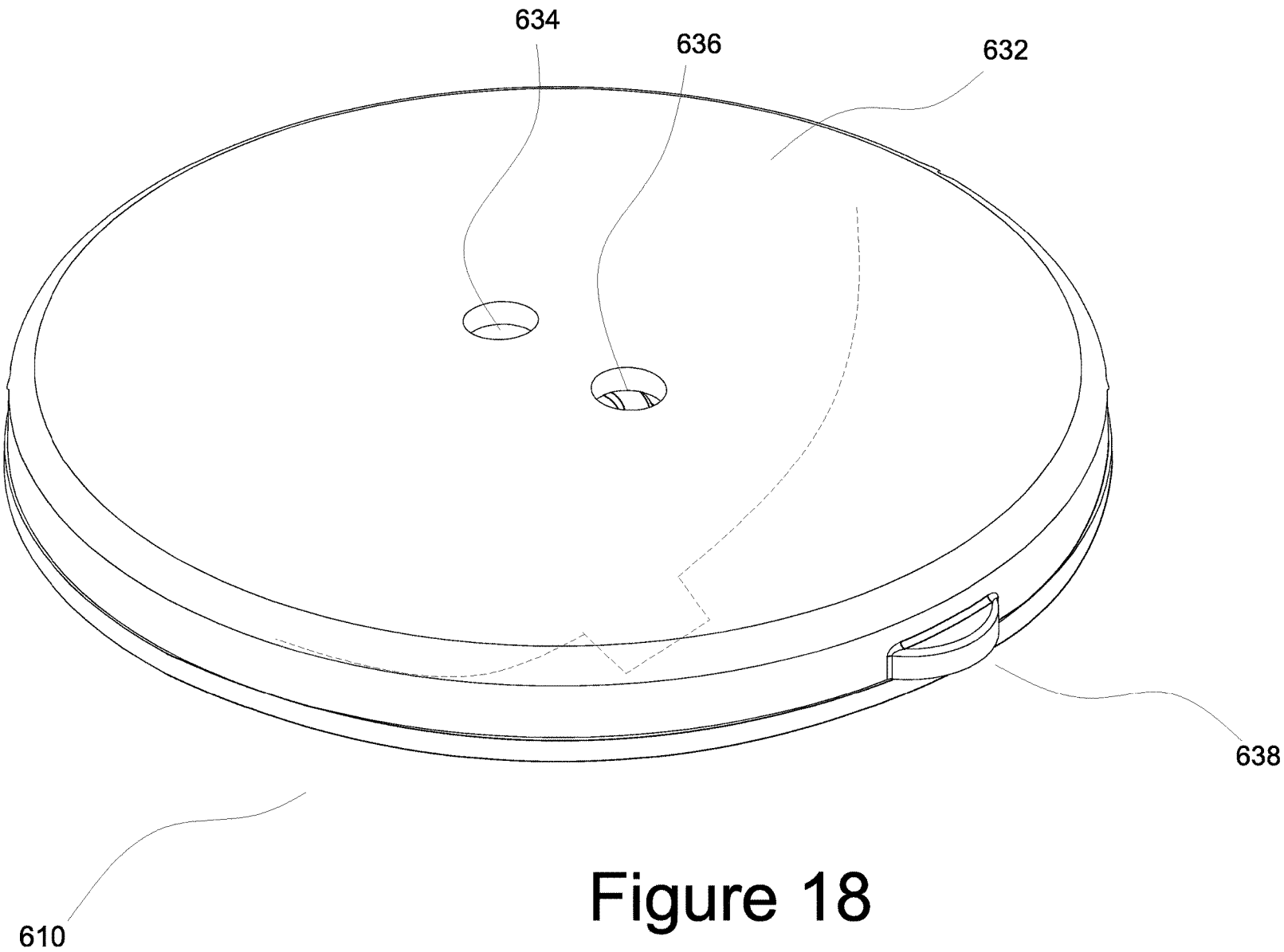
FIG. 18 is a perspective view of the inventive applicator with a cover place over the deodorant deposited on the applicator.

FIG. 18 illustrates another perspective view of applicator 610, but with a cover 632 disclose over its top surface to protect the deodorant material from being dislodged. Cover 632 is placed over base 612 (as seen in FIG. 13). Cover 632 has a protruding handle 638 which allows the user to remove cover 632 from base 612 (as seen in FIG. 13).

Cover 632 also comprises two holes 634 and 636. These holes serve a several distinct purposes. When the deodorant material is heated and in a liquid state it can be injected through holes 634 and 636 and onto the surface of deodorant applicator 610. In addition, cover 632 keeps deodorant applicator 610 substantially sealed and therefore protects the deodorant substance from dislodgement and deformation. Cover 632 holds the deodorant material in place when, after injection into covert applicator 610, it is in liquid form. This allows it to cool and harden in place over the raised rings 614 and corresponding circular channels 616. The cover 632 also protects the appearance of the product, for example in the event that the product is crushed. A sticker (not illustrated) may then be applied to cover 632 over holes 634 and 636 with a, for example, circular shape to match the cover 632 or other shape, sealing holes 634 and 636 on cover 632. Cover 632 thus provides a rigid protective member over the deodorant substance and base 612. The sticker also acts to seal the deodorant substance such that no substances can enter through the two holes 634 and 636.

The cover has a small tab 638 for the purpose of allowing one to rip cover 632 and take the cover off base 612. The base may also have a similar small tab such that the tabs can be worked against each other, aiding in the process of removing cover 632 from base 612. During manufacture, it is possible to create a specified angular orientation of one tab with respect to the other. For example, to off-set the two tabs, for example by 2-30° such that it is easy to push on one with the thumb of one hand and the other with the index finger of the same hand. Alternatively, the cover can be manufactured such that it can be rotated on the base, thus allowing the user to deviate the tabs to any angle he/she prefers.

Figure 19:
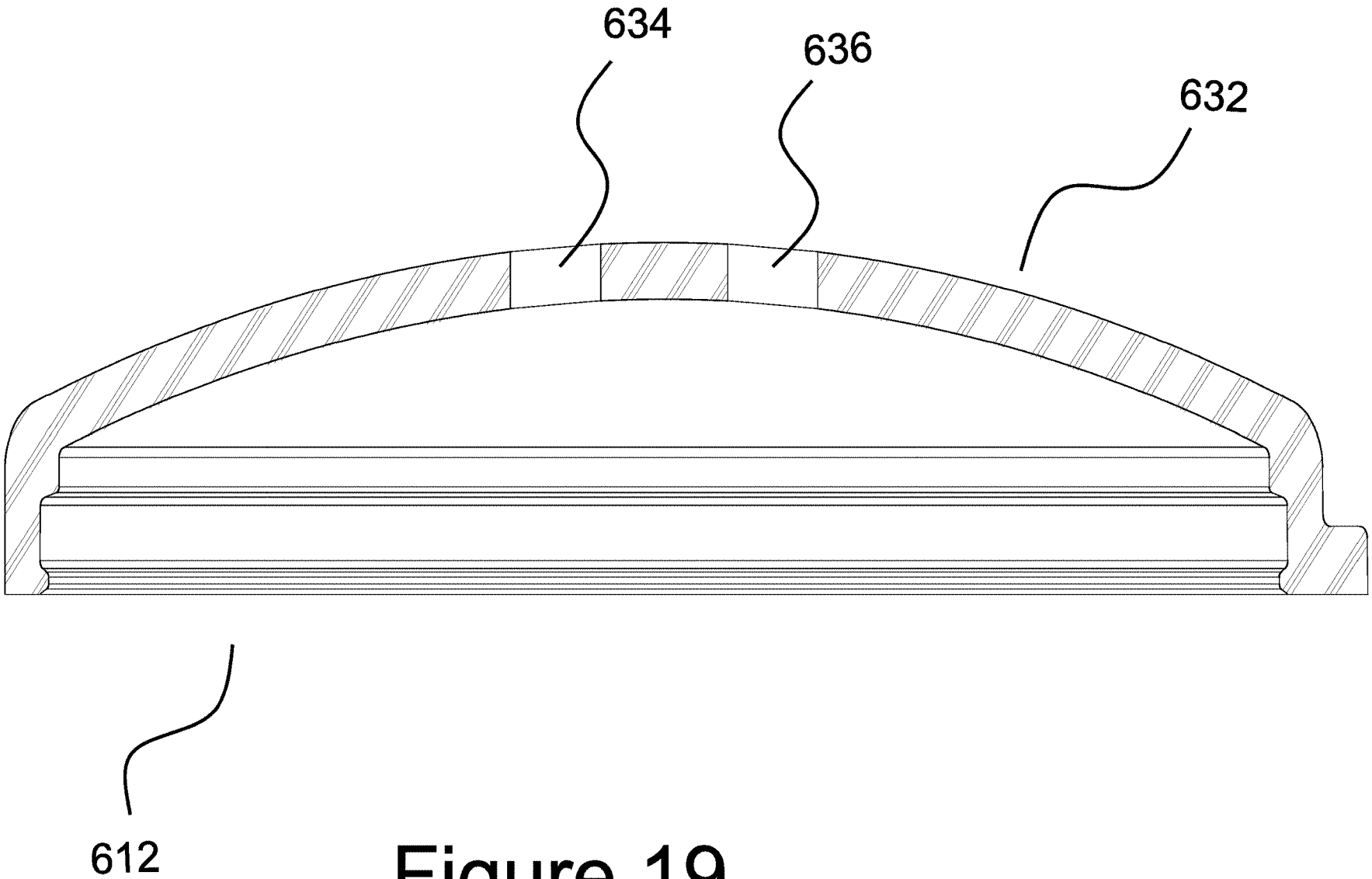
FIG. 19 is a sectional view of the cover.

FIG. 19 shows a sectional side-view of base 612 and cover 632. This view shows holes 634 and 636 passing completely through cover 632.

Figure 20:
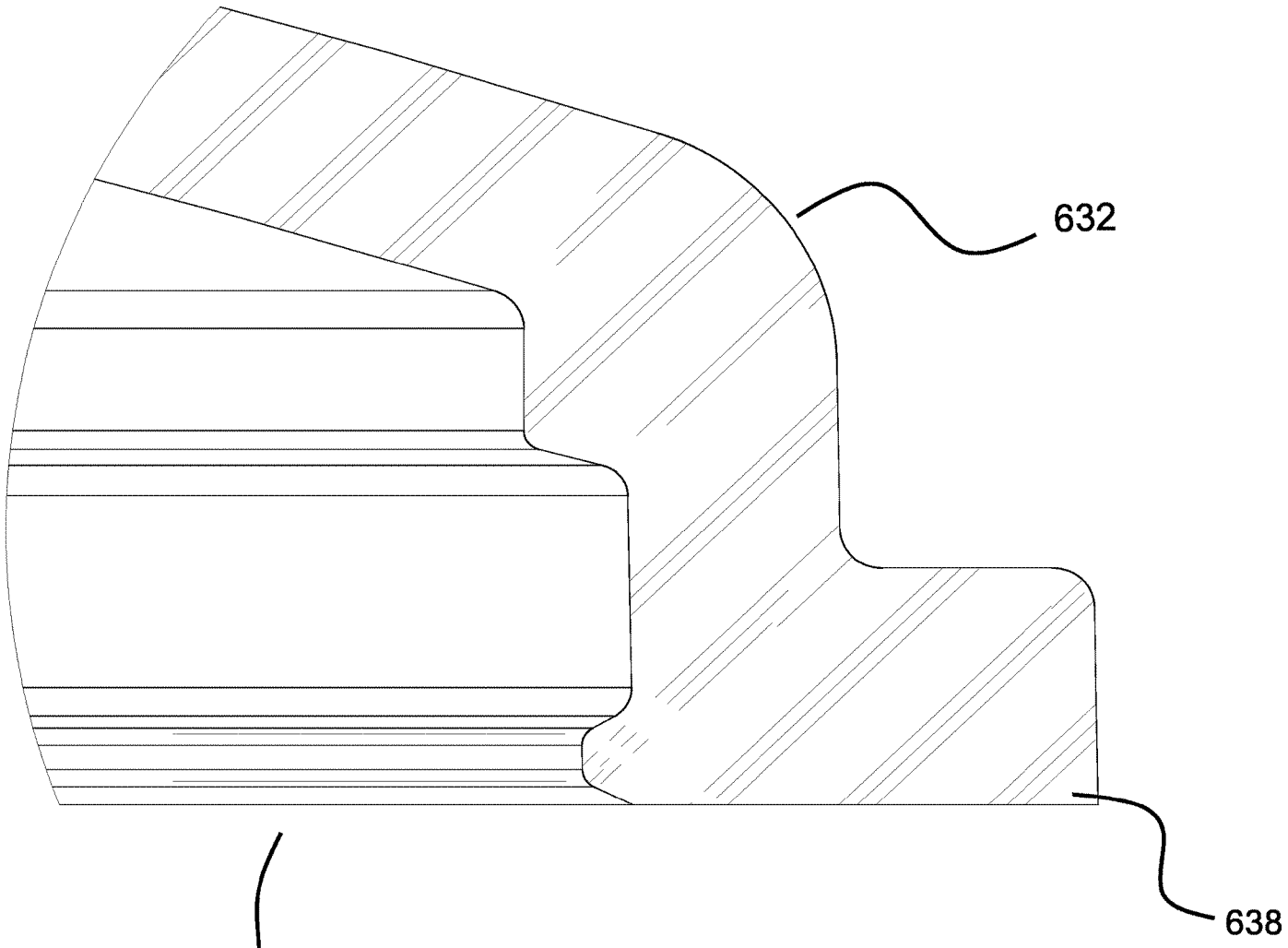
FIG. 20 is an enlarged sectional view of the cover, illustrating the edge of the base and cover.

FIG. 20 shows an enlarged sectional view of cover 632 and internal circumferential contours for receiving base 612.

This view is of the region at the region of engagement between the edge of base 612 and cover 632 where protruding handle 638 is located. Protruding handle 638 is part of cover 632. When the user lifts up protruding handle 638, protruding handle 638 and cover 632 are pulled up and away from base 612, creating space between base 612 and cover 632. This allows the cover 632 to be removed from base 612.

Figure 21:
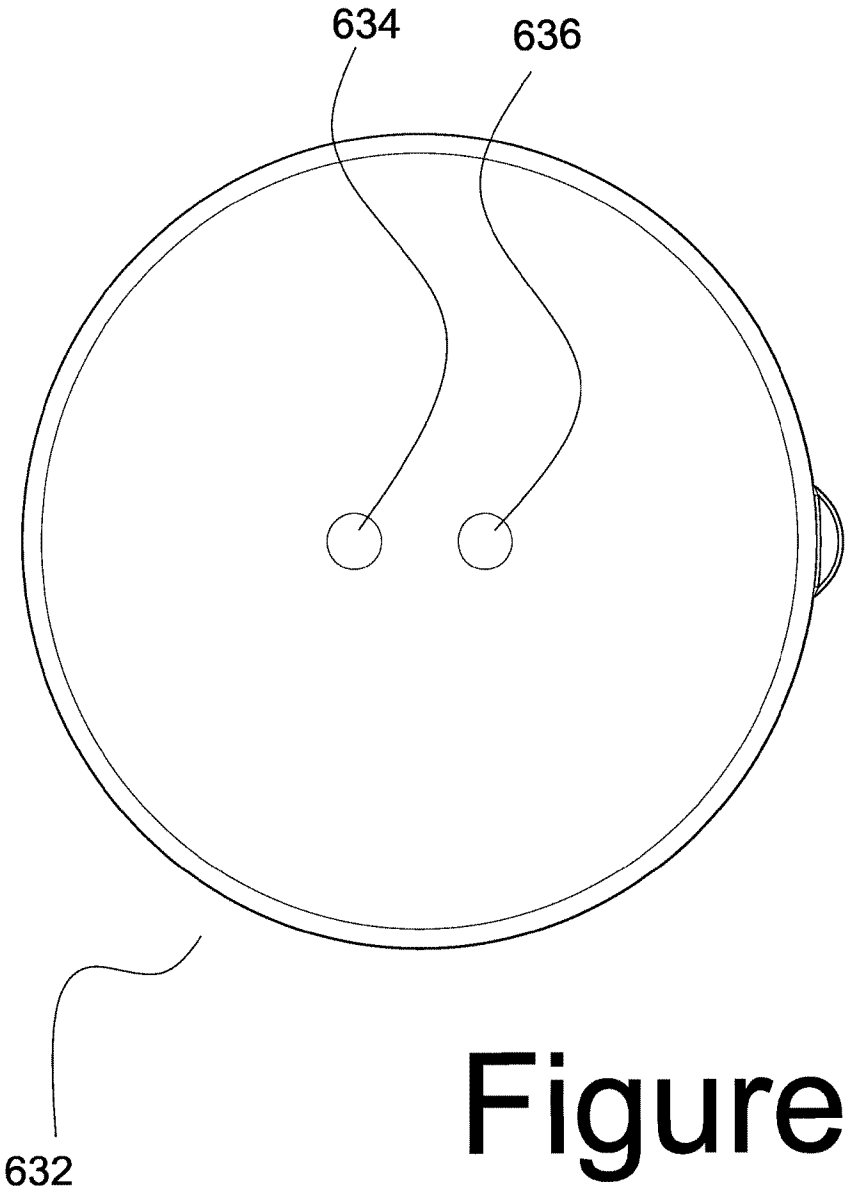
FIG. 21 is a top view of the cover.

FIG. 21 displays a top view of cover 632. This view shows the location of holes 634 and 636.

It is contemplated that the deodorant dispenser, with or without the cap, may be stored and transported in any suitable package. The package may be a ketchup-packet-type package, whereby the deodorant dispenser may be packaged in the same manner as is illustrated in FIG. 5. Alternatively, the deodorant dispenser, with or without the cap, can be included in one compartment of a two-compartment package.

In accordance with this last embodiment, the second compartment may contain a wipe, for example a conventional wipe with an alcohol-based cleaning material to allow the individual to clean him/herself before applying the deodorant. The packet may have a dimension of about 6 cm square, or perhaps slightly longer on one side and may be comprised of first, second and third heat sealable sheets, we need applicator between the first and second sheets and the wipes between the second and third heat-sealable sheets. The deodorant support may have a dimension of approximately 4.5 cm.

Figure 22:
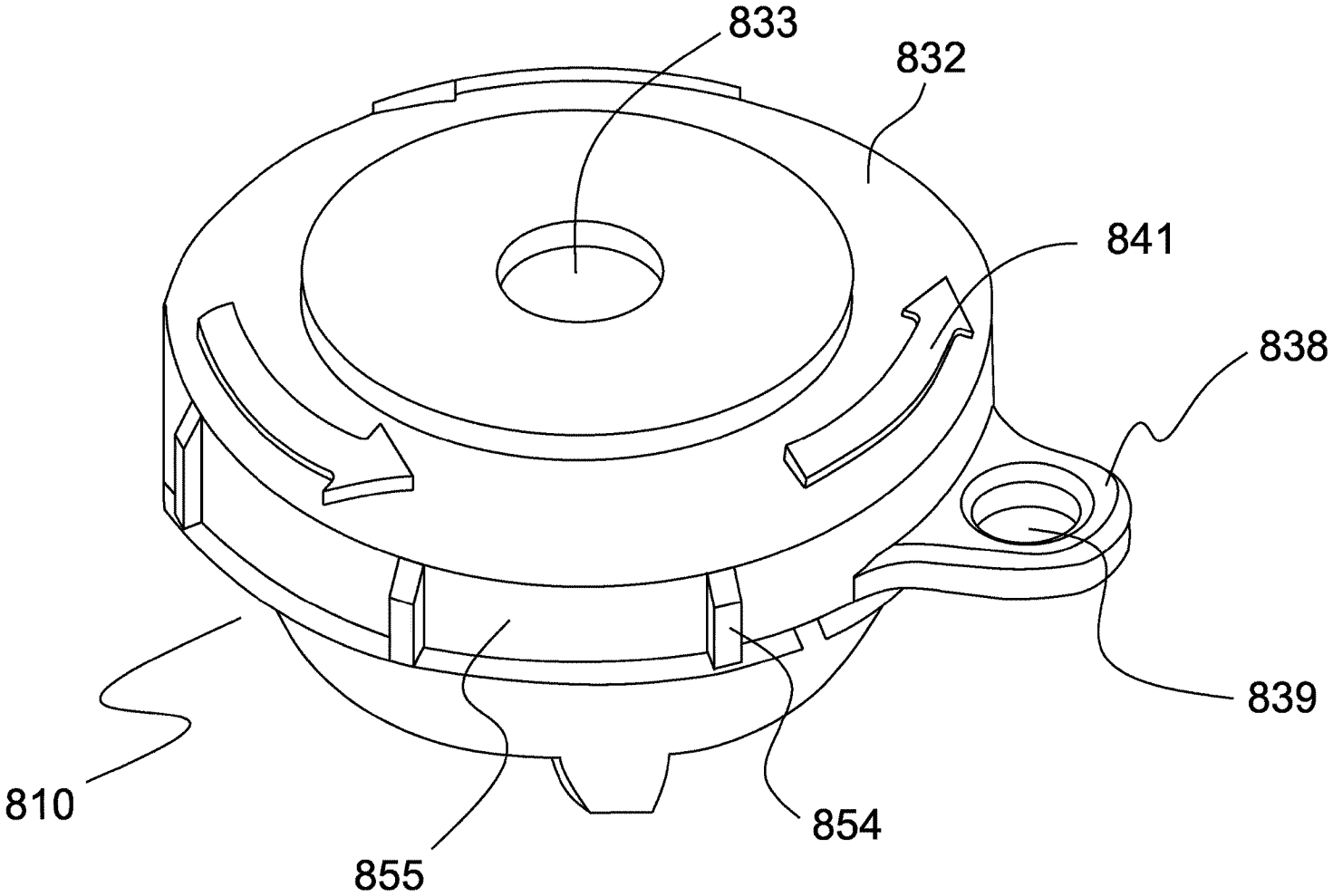
FIG. 22 is a perspective view of the inventive applicator with a cover placed over the deodorant deposited on the applicator.
Figure 23:
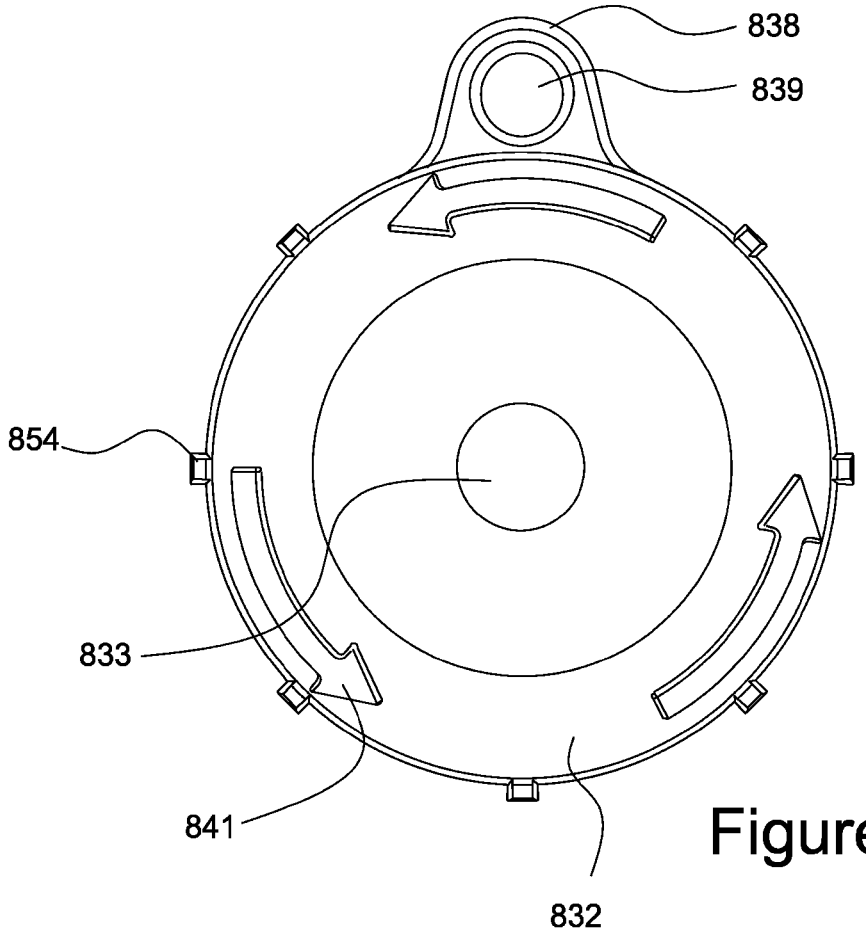
FIG. 23 is a top view of the cover.

Referring to FIGS. 22-23, views of an alternative embodiment of the deodorant applicator 810 is shown, with a cover 832 disclosed over its top surface to protect the deodorant material from being dislodged. Cover 832 has a protruding handle 838. Protruding handle 838 has a hole 839 which allows the user to attach applicator 810 to other things such as a backpack, clothing, etc. Cover 832 also comprises hole 833 which may be used to inject deodorant material, in liquid state, onto the surface of the deodorant applicator 810. The deodorant material Cover 832 comprises notches 854 located on the side 855 of top cover 832. Notches 854 allow for user to more easily dislodge top cover 832 from base 812. Cover 832 may also have arrows 841 which illustrate, to the user, the direction in which the cover 832 may be moved to dislodge top cover 832 from base 812.

Although top cover 832, as shown in FIGS. 22-23, is round shaped, top cover 832 can have different shapes. In addition, a sticker (not illustrated) may be applied to cover 832, over hole 833. The sticker may be shaped to match the shape of top cover 832, sealing hole 833 and protecting the deodorant substance.

Figure 24:
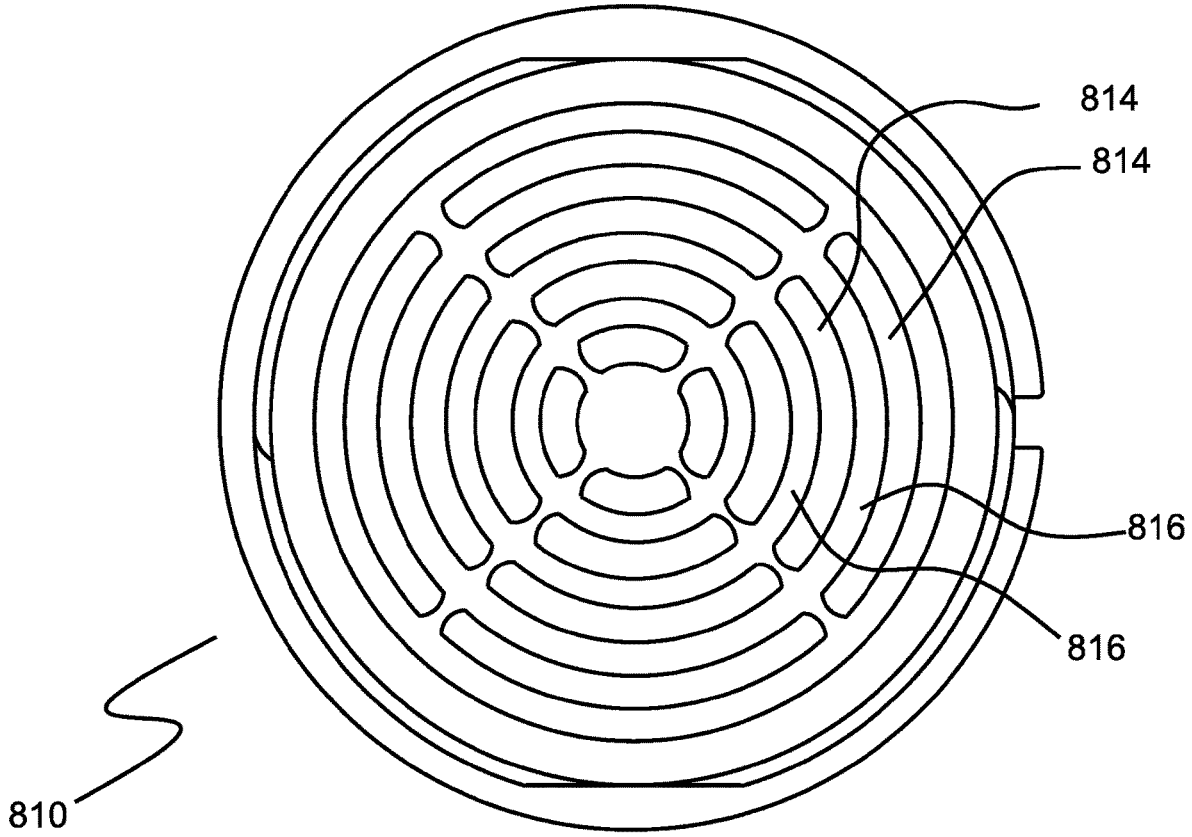
FIG. 24 is an alternate embodiment of a top view of the deodorant-receiving surfaces.

FIG. 24 illustrates the top view of base 812 of applicator 810 with cover 832 removed. The figure also shows the raised rings 814 and corresponding channels 816. Raised rings 814 and channels 816 are shaped and spaced in such a way as to allow for deodorant material 52 to be affixed to base 812 by utilizing raised rings 814 and channels 816 as an adherence surface. Deodorant material 52 may be deposited onto base 812 to form a flat surface or it may be deposited onto base 812 to form a convex or domed configurations. Such configurations allows for easier application of the product onto the skin of the user.

The outermost rings of deodorant material 52 are relatively low and the central deposition of deodorant material 53 is in the highest position. Accordingly, together rings of deodorant material 52 and the central circular deposition of deodorant material 53 generally defined a convex or domed configuration.

Figure 25:
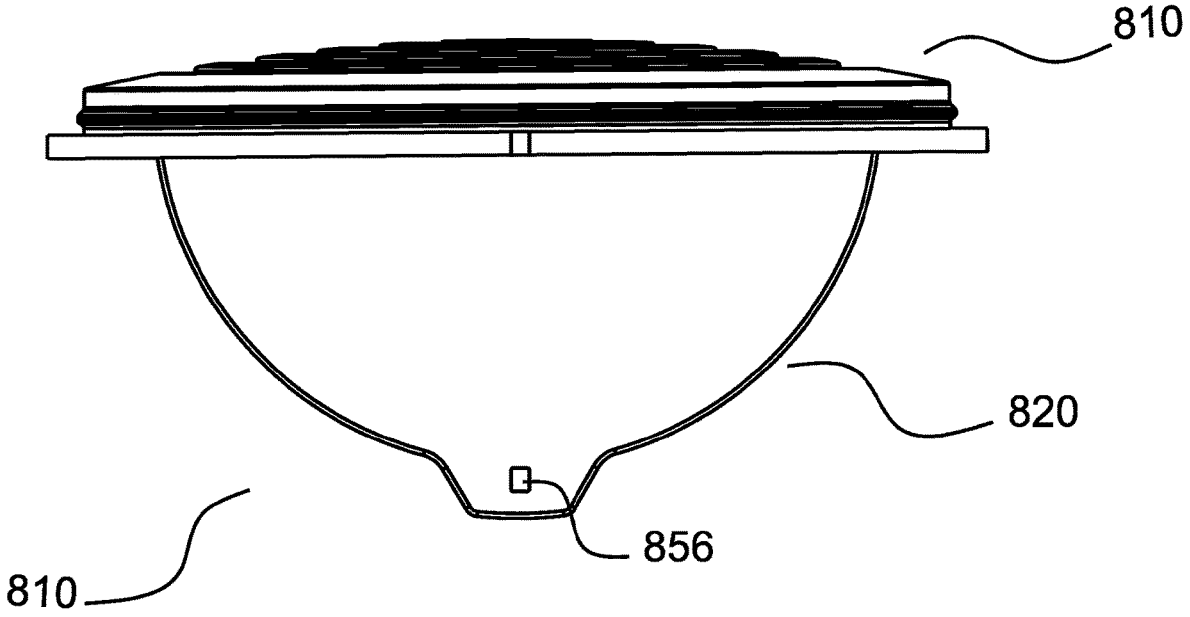
FIG. 25 is a side view of a living hinge applicator.

FIG. 25 displays a side view of the living hinge applicator 810. The shape of the handle 820 can be seen from this view. The shape of handle 820 is substantially the same as handle 620, as shown in FIG. 15. Handle 820 comprises a protruding handle notch 856.

Figure 26:
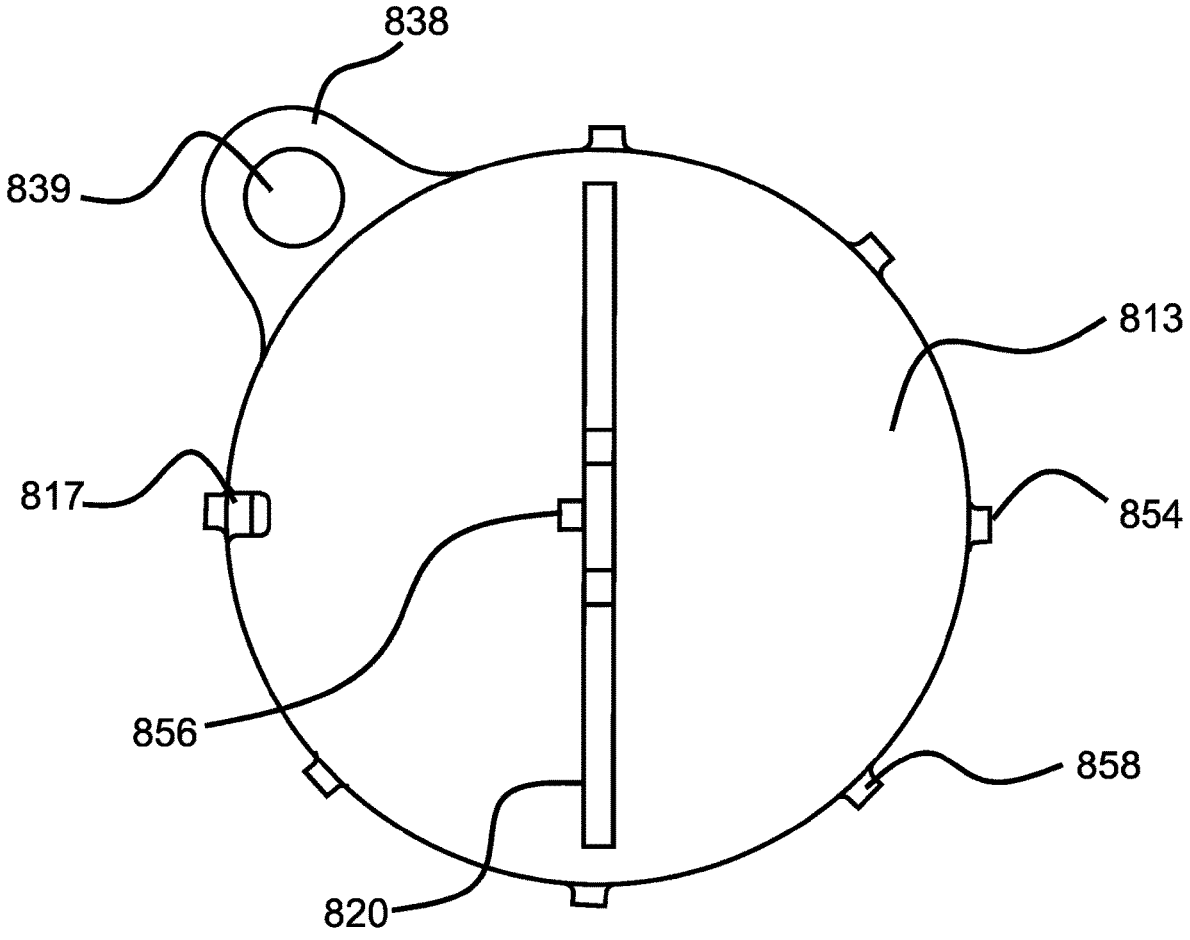
FIG. 26 is a top view of a bottom portion of the applicator.
Figure 27:
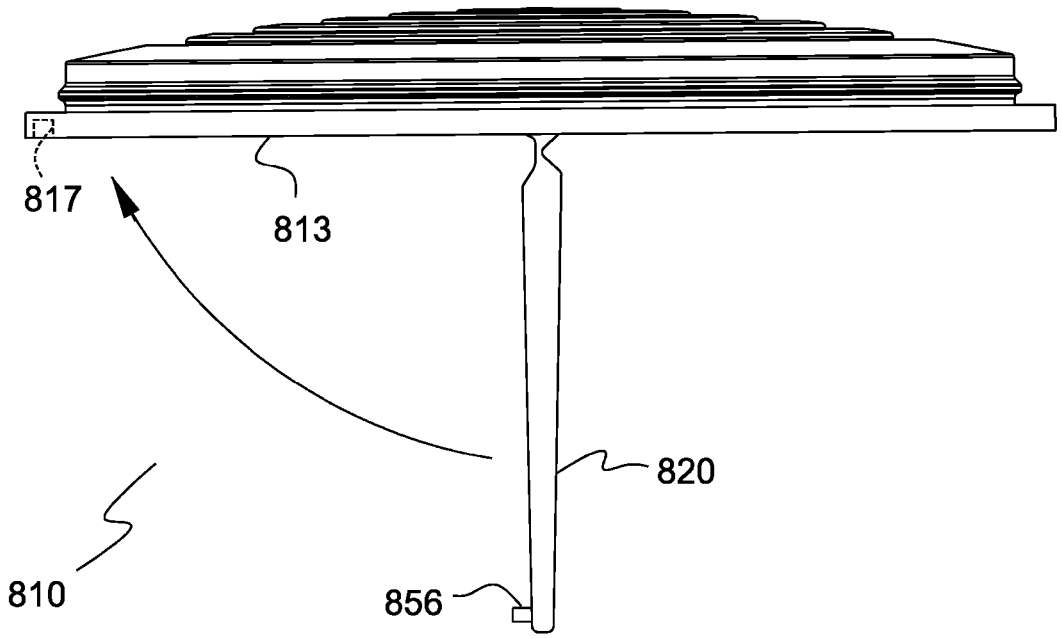
FIG. 27 is a side view of a living hinge embodiment of the applicator of the present invention with the grasping handle.

FIG. 26 is a top view of the bottom portion 813 of applicator base 812. Bottom portion 813 has an opening 817 that is sized to fit notch 856 when handle 820 is moved in the direction of the arrow, as illustrated in FIG. 27. Notches 854 that are located on cover 832 have hollow spaces 858, configured to the same size as notch 856 located on handle 820 as well as opening 817 located on the bottom portion 813 of applicator base 812.

Referring to FIG. 27, when user finishes applying the topical substance held by applicator base 812, the user places cover 832 onto applicator base 812 and rotates cover 832 in clockwise direction to seal it onto applicator base 812. At that point, the handle 820 is substantially perpendicular to the base 812. The user then moves handle 820 to be folded to the base 812 allowing for notch 856 to be coupled to the hollow space 858 (not illustrated in FIG. 27) through opening 817. This allows for the cover 832 to be securely locked to the applicator base 812 preventing the cover 832 from dislodging from base 812.

Alternatively, notches 854 may have the hollow spaces 858 configured so that notch 856 is coupled with one of hollow spaces 858 even if base 812 does not comprise opening 817.

Figure 28:
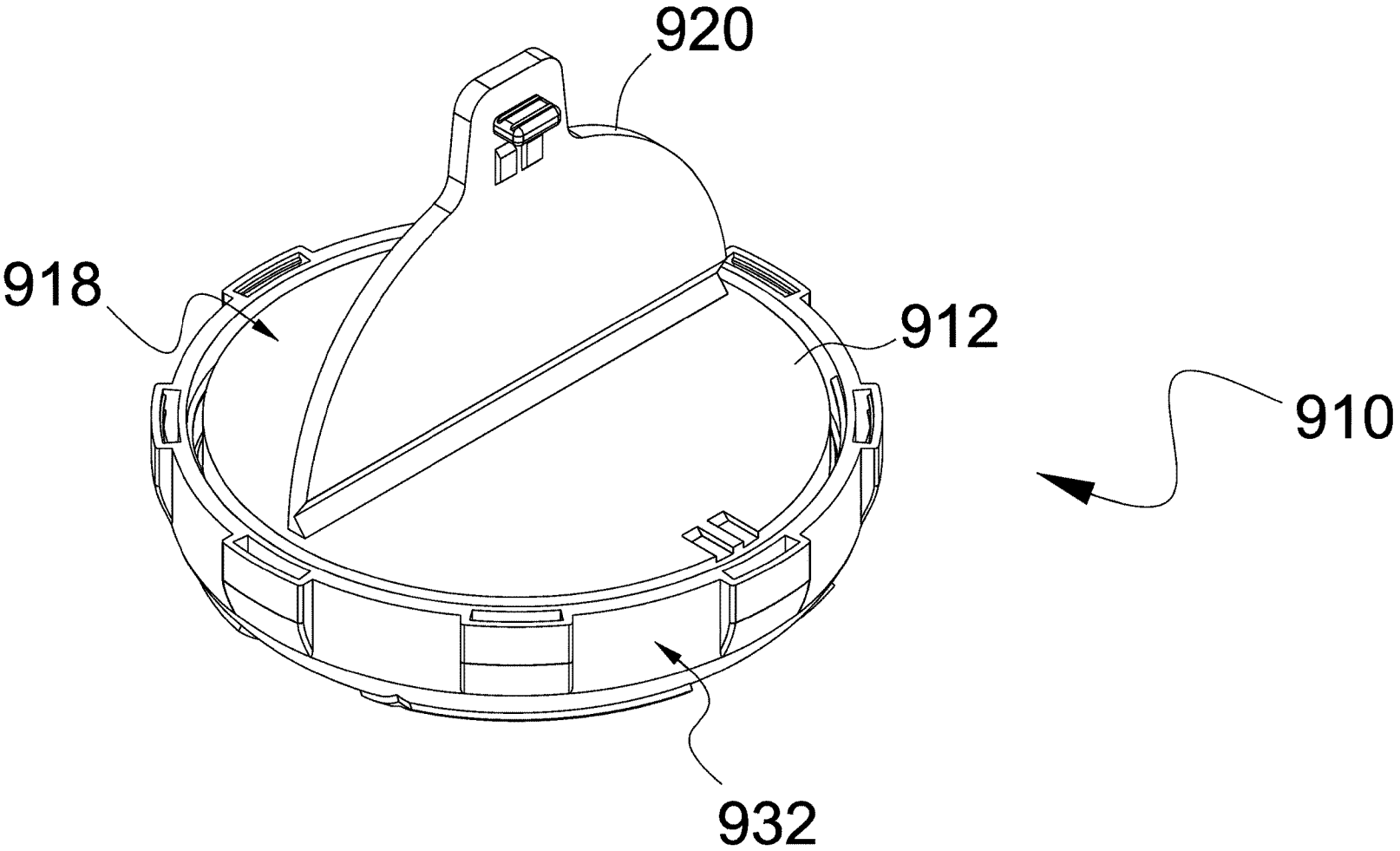
FIG. 28 is an isometric bottom view of a living hinge embodiment of the deodorant dispenser of the present invention closed with a cap and with a handle in a use position attached to the base.

Referring to FIG. 28, a particularly advantageous embodiment of the invention is illustrated. A single-use deodorant dispenser 910 is composed of plastic in accordance with this preferred embodiment of the invention. Alternatively, other materials may be used, such as polymeric composites, for example composites incorporating fibers such as graphite or fiberglass, or metal.

Deodorant dispenser 910 comprises an applicator 918 and a cap 932. Applicator 918 and cap 932 together form a container for containing the material to be dispensed, such as deodorant, sunscreen, antibiotic, anesthetic, poison ivy treating, bug repellent, antihistamine, skin moisturizer, cortisone or allergic reaction treating materials.

The material being applied by dispenser 910 is contained within dispenser 910, having been deposited therein as is detailed below. The applicator 918 comprises a rigid base 912 which functions as a foundation upon which the rest of the device is constructed and a handle 920 attached to applicator base 912. In accordance with the present invention, half disc shaped gripping portion of handle 920, together with handle base 911 and living hinge portion 922 are manufactured as a separate part, for example by injection molding plastic into a mold. Handle base 911 is secured to the underside 923 of applicator base 912.

During use, the user rotates handle 920 angularly from the flat position (FIG. 30) to the position illustrated in FIG. 28. Cap 932 is then unscrewed and removed to expose the material to be applied, allowing use of the material by application to, for example, the skin, by the user holding extended out handle 920 while smearing the material onto the skin. The user, after application, places cap 932 onto applicator base 918 and rotates cap 932 in the clockwise direction to seal it onto applicator base 912, protecting the material until the next use.

Base 912 is disc shaped and its diameter can vary between 12 and 110 millimeters and its thickness 913 (FIG. 32) may vary typically from 1 to 2 mm, or it may have any thickness sufficient to result in substantial rigidity of the base in its role of supporting the material being dispensed (for example deodorant or sunscreen). Base 912 must stably support the material being dispensed during application to the skin.

In accordance with the preferred embodiment, the base has a diameter ranging between 12 mm and 110 mm. The material receiving volume must be sufficient to receive the material being dispensed with an average thickness 947 ranging between 1 mm and 14 mm. More preferably the base has a diameter ranging between 20 mm and 80 mm with a material receiving volume having an average thickness 947 ranging between 2 mm and 10 mm. Most preferably, the base has a diameter ranging between 25 mm and 60 mm with a material receiving volume having an average thickness 947 ranging between 3 mm and 8 mm, or perhaps ideally between 4 and 6 mm.

In accordance with the invention, it is contemplated that deodorant dispenser 910 has an internal volume 948 (FIG. 31), which comprises a volume 951 (which houses the actual material being applied) (FIG. 32) located above arcuate walls 914 which receives the material to be dispensed and has an average thickness 947. Internal volume 948 further comprises an additional volume 953 which is defined in between arcuate walls 914, which holds material which provides a support function for the material (located above the arcuate walls 914) being applied.

Figure 29:
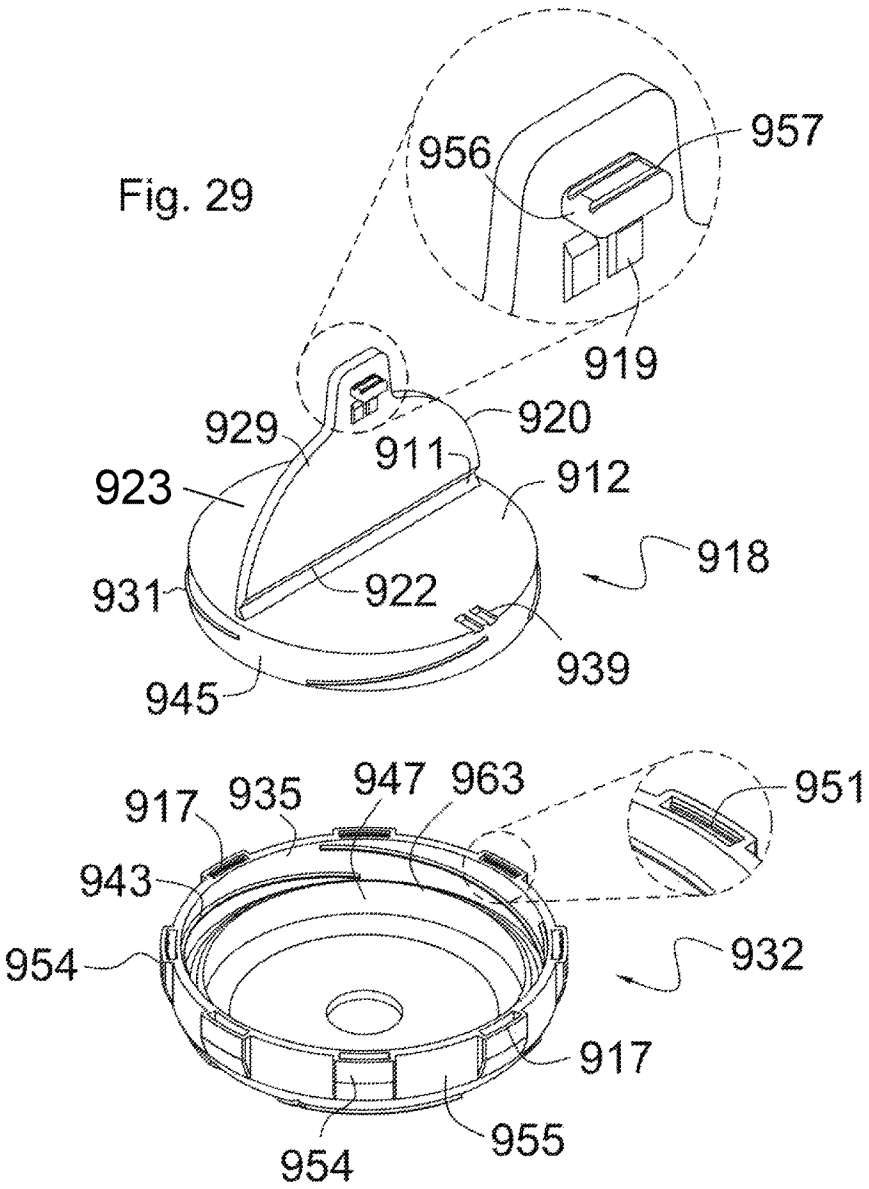
FIG. 29 is an isometric bottom view of the deodorant dispenser with removed cap separated by moving the cap translationally downwards away from the applicator and with a grasping handle in the use position attached to the base.

As illustrated in FIG. 29, base 912 comprises a cylindrical side wall 945 which includes threads 931 on the radially outer surface of side wall 945. Thread 931 is configured to mate with a mating thread 943, located on the radially inside surface 935 of a cap side wall 955 of cap 932.

Cap 932 further comprises an annular sidewall 947 (diagrammatically shown in FIG. 34) positioned radially inward with respect to cap side wall 955 (FIG. 29). Referring to FIG. 29, when cap 932 is tightly screwed into applicator 918, top surface 963 of annular sidewall 947 and bottom surface 965 (FIG. 33) of side wall 945 sealingly contact each other. More particularly, when cap 932 is screwed onto applicator 918, referring back to FIG. 34, top surface 963 advances in the direction of arrow 967, from the position shown in solid lines, toward bottom surface 965 of annular sidewall 947, to the position shown in dashed lines, to provide engagement between the two surfaces 963 and 965. This provides for sealing the contents of the inventive container.

More particularly, in accordance with one embodiment of the present invention, the slanted surface 970 of wedge 968 may be driven against the corner 966 of surface 965. In this case, the result is slight deformation of corner 966 and the confirmation of corner 966 and slanted surface 970 assures a high quality seal. This results in very effective sealingly securing cap 932 on applicator 918.

In accordance with the present invention, cap 932 has eight securing positions. That is, when cap 932 is to be screwed in all the way, it can be positioned in eight different ways relative to applicator 918 and handle 920, as will be detailed below in connection with the description of FIG. 30.

Referring to FIG. 29, handle 920 comprises a mounting hinge base member 911 and rigid gripping portion 929. Handle 920 further comprises a living hinge 922, which connects the mounting member 911 to the rigid gripping portion 929. Mounting hinge base member 911 is attached to the underside of base 912 by a heat weld or any other suitable means. Living hinge 922 allows rigid gripping portion 929 to swivel out from a position lying flat against base 912 (FIG. 30), to a position roughly perpendicular or nearly perpendicular to the bottom surface of base 912. This provides for convenient gripping during use. After use or while it is, for example, inside a consumer package, rigid gripping portion 929 may positioned parallel to the bottom surface of base 912.

When it is desired to use the deodorant dispenser, the user can rotate handle 920 away from base 912, such that handle 920 is substantially perpendicular to the base 912, allowing the user to grasp the handle 920 and use the deodorant applicator 918. After use, it may be rotated back to the storage position illustrated in FIG. 30.

Referring back to FIG. 29, rigid gripping portion 929 comprises a prong 956 used to lock gripping rigid gripping portion 929 in the storage position (FIG. 30) by being snapped into one of the eight sockets 954 (FIG. 29). Rigid gripping portion 929 further comprises studs 919 configured to be positioned inside pockets 939 of the base 912 when rigid gripping portion 929 is in storage position. Studs 919 coupled with pockets 939 provide a fictional gripping surface to more securely hold rigid gripping portion 929 when rigid gripping portion 929 is in the storage position.

Figure 30:
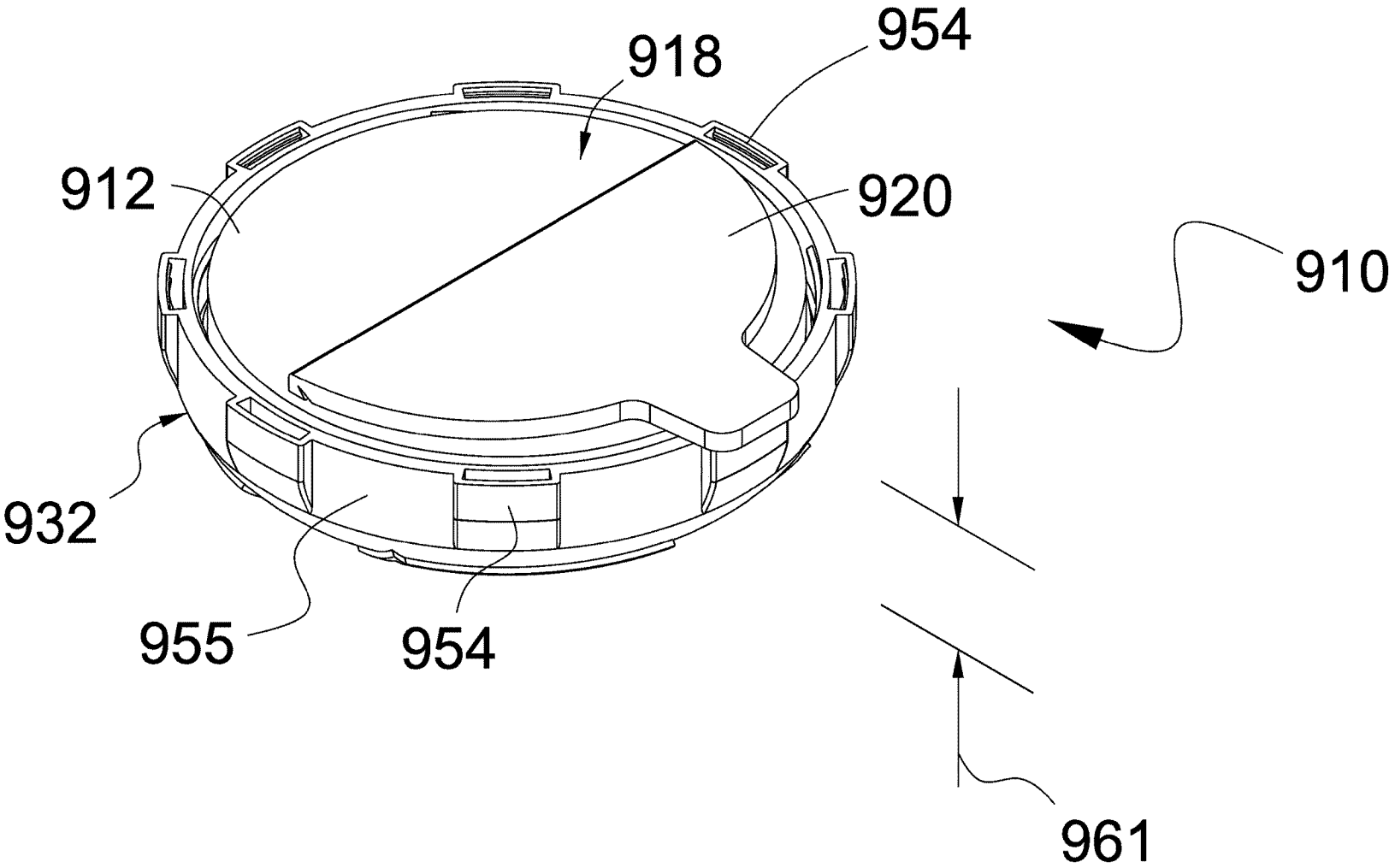
FIG. 30 is an isometric bottom view of the deodorant dispenser closed with a cap and with a handle in the storage position attached to the base.

Referring to FIG. 30, an isometric bottom view of the deodorant dispenser 910 with a cap 932 secured in position closing dispenser 910 is illustrated. Handle 920 in the storage position is illustrated. After deodorant 910 is manufactured and cap 932 is tightly screwed into the applicator 918, handle 920 is folded to the position illustrated. When handle 920 is in the storage position, deodorant dispenser 910 may be packaged in a flat envelope like container. One of the sockets 954 receives the prong 956 of handle 920 when handle 920 is in the storage position. Depending on how the user engages cap 932 and applicator 918, one of the sockets 954 will be positioned to receive the prong 956 when cap 932 is tightly secured on the applicator 918. Each socket 954 can be positioned to receive the prong 956.

Sockets 954 contain indents 951 best seen in FIG. 29 which when coupled with notches 957 of the prong 956 secure handle 920 in storage position. Sockets 954 protrude beyond cylindrical wall 955 thus forming gripping parts which allow the user to more easily dislodge cap 932 from applicator 918.

The thickness 961 (FIG. 30) of the outer surfaces of the deodorant dispenser with closed cap 932 and handle 920 in the storage position may vary and be in the range between 5 mm and 30 mm More preferably thickness 961 is ranging between 5 mm and 25 mm. Most preferably, the thickness 961 is ranging between 8 mm and 12 mm.

Figure 31:
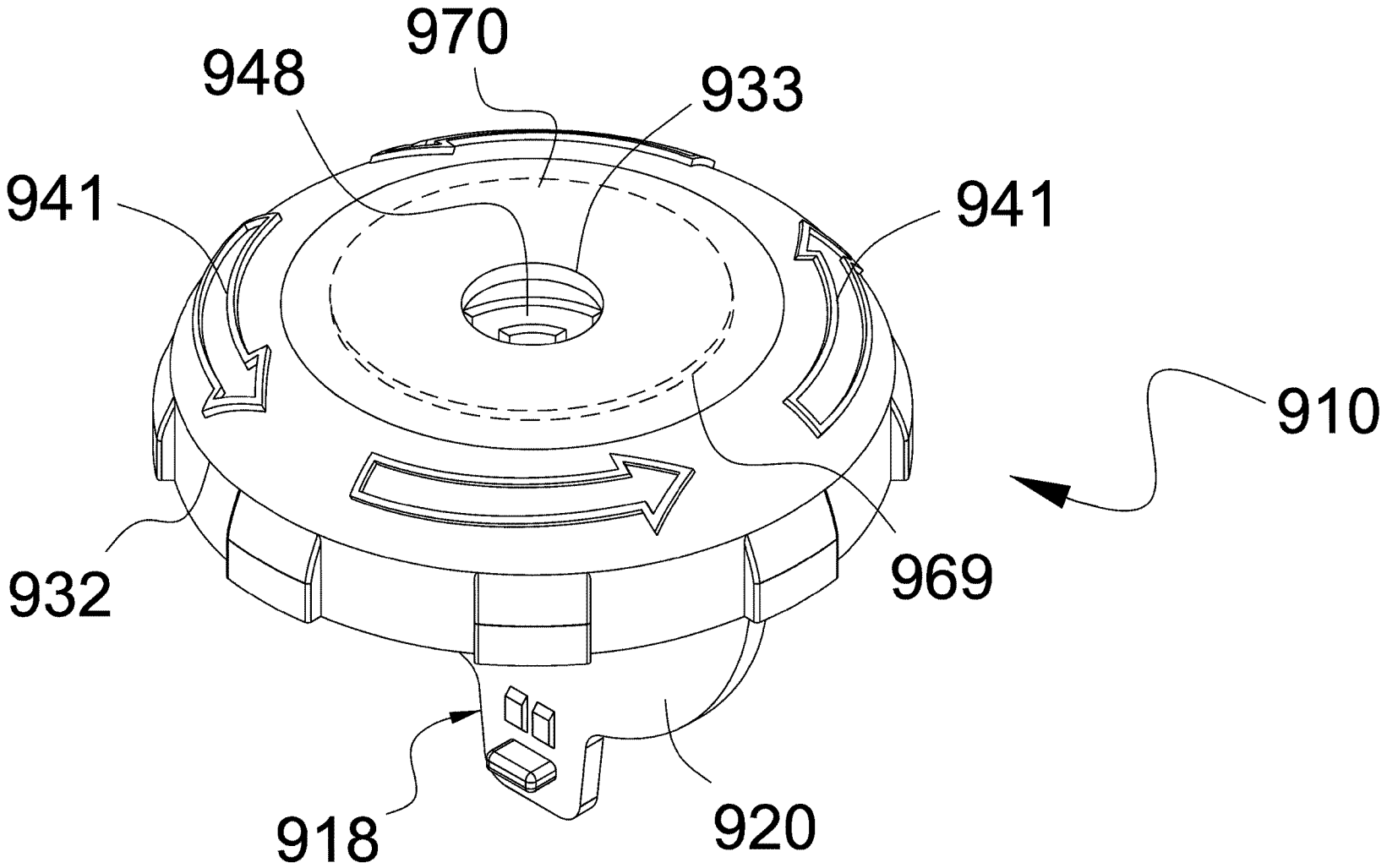
FIG. 31 is an isometric top view of the deodorant dispenser closed with a cap and with a handle in the use position attached to the base.

Referring to FIG. 31, an isometric top view of deodorant dispenser 910 with cap 932 screwed into the applicator 918 and handle 920 in the gripping position is illustrated. Cap 932 has arrows 941 which illustrate, to the user, the direction in which cap 932 is rotated to dislodge cap 932 from applicator 918. When deodorant dispenser 910 is manufactured, cap 932 is screwed into the applicator 918. After closure of the applicator by cap 932, solidifying liquid or gel material to be applied 949 (FIG. 32) is filled, while still liquid, into internal volume 948 through a hole 933 in cap 932. Once internal volume is sufficiently filled with the liquid or gel material to be applied, a self-adhesive sticker 969 (FIG. 31) shown in dashed lines is attached to surface 970, sealing the material in the inventive dispenser 910. Sticker 969 is made, for example, of plastic or paper, and has glue on the side that engages surface 970 which results in sealing hole 933.

Figure 32:
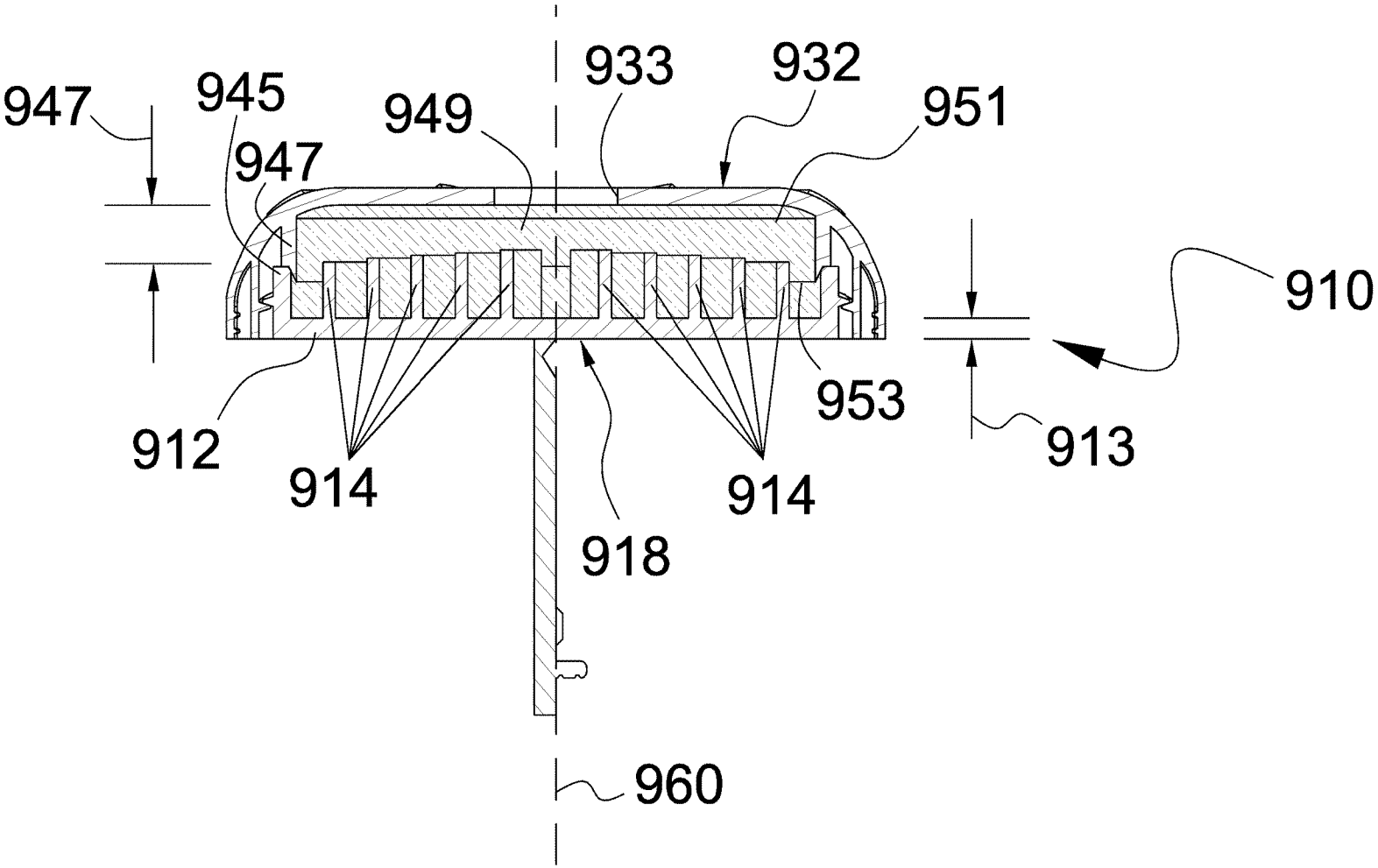
FIG. 32 is a cross sectional view of the deodorant dispenser closed with a cap and with a handle in the use position attached to the base.

Material to be applied 949 is best seen in FIG. 32, where a cross sectional view of the deodorant dispenser with a closed cap 932 and handle 920 in gripping position is illustrated. As is illustrated, arcuate walls 914 are perpendicularly oriented with respect to and attached to the base 912. Liquid or gel material to be applied is affixed to the base 912, radially inner surface of side wall 945 and arcuate walls 914.

The height of arcuate walls 914 increases as the radius decreases. That is arcuate walls 914 positioned closer to the line 960 have greater height than arcuate walls positioned further from the line 960. In accordance with the present invention, heights of the arcuate walls may vary between 30% and 80% of the height of the space between the top and the bottom of the inner volume. More preferably heights of the arcuate walls may vary between 35% and 70% of the height of the space between the top and the bottom of the inner volume. Most preferably, heights of the arcuate walls may vary between 45% and 60% of the height of the space between the top and the bottom of the inner volume.

Figure 33:
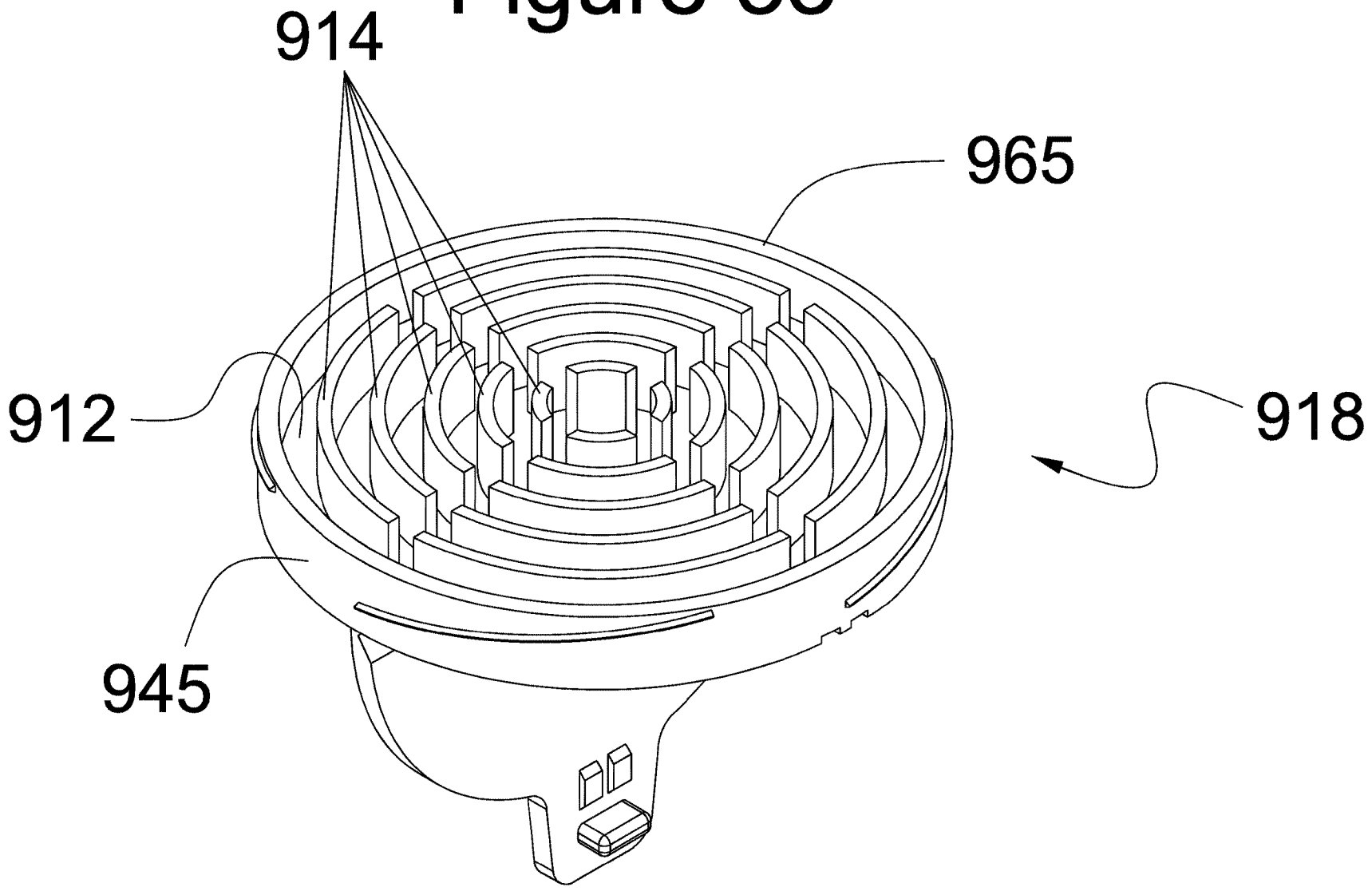
FIG. 33 is a cross sectional view of the deodorant dispenser without a cap and with a handle in the use position attached to the base.
Figure 34:
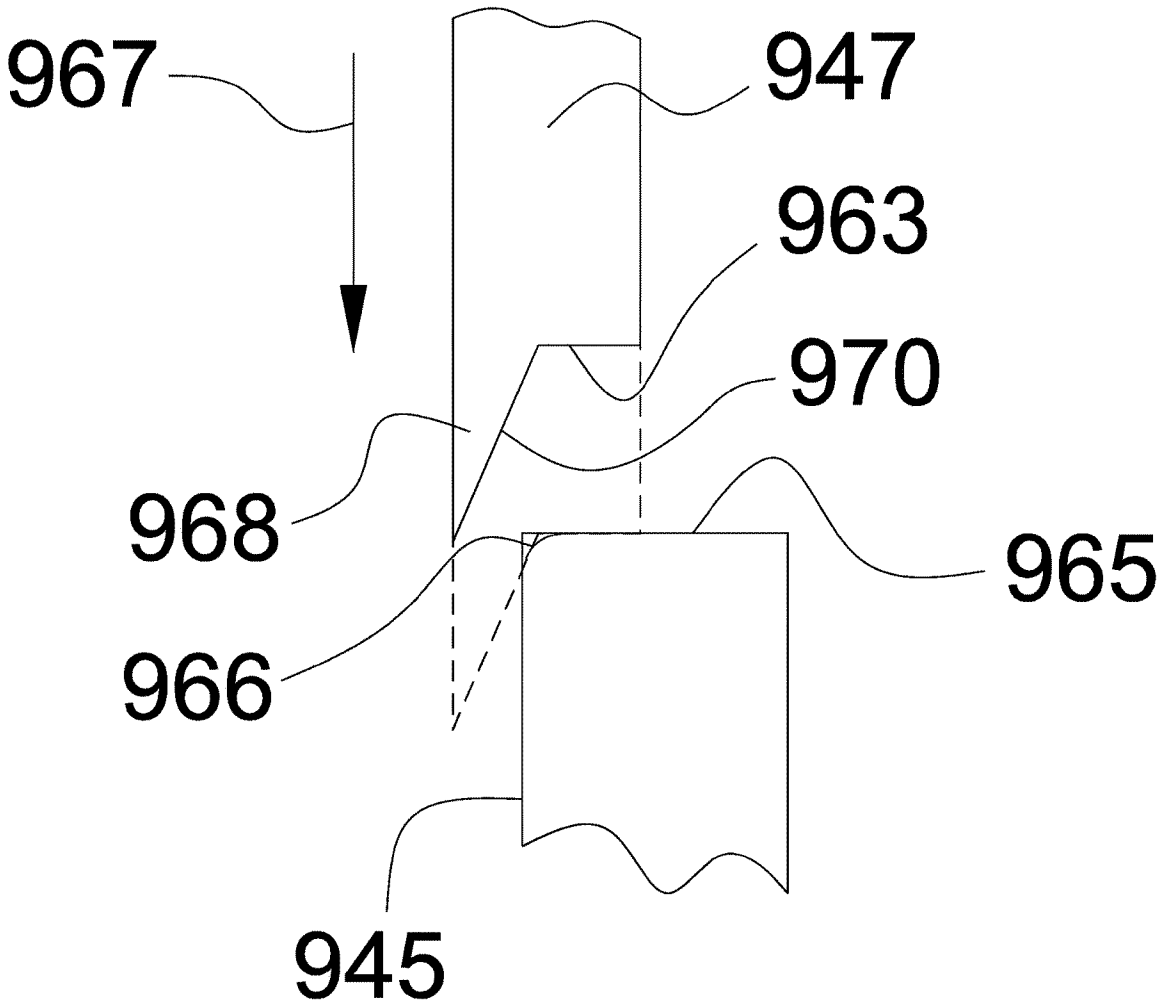
FIG. 34 is a diagrammatic view showing the seal between cap and deodorant dispenser.

An isometric top view of the applicator 918 is illustrated in FIG. 33 where the shape of the arcuate walls 914 can be better understood. Arcuate walls 914 are formed by dividing a ring into a four equal size arcs. The number of rings divided by equal size segments can vary and be, for example, between 1 and 20 or any other number rings that will provide substantial surface area to affix the material to be applied 914 and prevent it from detaching while deodorant dispenser 910 is being used or stored. In accordance with the preferred embodiment, there are five raised rings and each ring is divided into four segments of equal length forming arcuate walls 914. The thickness of the arcuate walls 914 may vary and be in the range, for example, 0.1-2 mm. More preferably, the thickness of the arcuate walls 914 is ranging between 0.1 mm and 1 mm. However, these dimensions are not very critical.

Arcuate walls 914 are shaped and spaced in such a way that the material to be applied 914, in either gel or solid form, can be affixed to the applicator 918 with the deodorant engaging arcuate walls 914, top surface of base 912 and sidewall 945 as an adherence surface. Radius of the arcuate walls 914 may vary and increases by equal increments in order to radially uniformly distribute rings on the surface of the base 912 as illustrated in FIG. 33. In accordance with the particular embodiment, the diameter of the smallest arcuate wall 914 is 7.1 mm and increases by 6.7 mm increments. That is the radii of the arcuate walls from smallest to largest are 7.1 mm, 13.8 mm, 10.5 mm and 27.2 mm, respectively, in accordance with the preferred embodiment. However, the same is not critical.

The manufacturing of the single-use deodorant applicator 2 is done by injecting plastic into a mold. Alternatively, the desired member may be made by blow forming and die cutting a sheet of plastic. Multiple members may be formed simultaneously across the width of a plastic sheet web in a continuous blow forming process, thus allowing for mass production. Further, applicator 2 may be made of polypropylene or other materials having characteristics similar to polypropylene.

While the above description of the embodiments focuses on deodorant, other personal hygiene or topical products may be used as well. For example, personal hygiene or topical products such as anti-perspirants, sunscreens, lip balm, fragrance, pain-relievers such as IcyHot®™, anti-chafing balm such as Glide®™, etc. may be used.

While illustrative embodiments of the invention have been described, it is noted that various modifications will be apparent to those of ordinary skill in the art in view of the above description and drawings. Such modifications are within the scope of the invention which is limited and defined only by the following claims.

What is claimed:

1. Dispensing apparatus for the application of an applyable personal hygiene or topical substance to the surface of the human body comprising:
   (a) an applicator comprising:
      (i) a base portion, said base portion having a personal hygiene or topical substance support surface; and
      (ii) a gripping portion, said gripping portion being attached to said base portion;
   (b) a personal hygiene or topical substance secured to the personal hygiene or topical substance support surface on said base portion of said applicator; said base portion, gripping portion and personal hygiene or topical substance forming an applicator; and
   (c) a protective member, adapted to be secured to said base portion, said protective member defining a closed compartment protecting and housing said personal hygiene or topical substance, said protective member comprising an engagement structure integrally formed with said protective member, said engagement structure adapted to receive and engage mating engagement structure on said gripping portion when said gripping portion is rotated proximate to said base portion, whereby the overall size of the dispensing apparatus is reduced.

2. Apparatus as in claim 1, wherein said engagement structure comprises a plurality of sockets integrally formed with said protective member and said mating engagement structure comprises a prong.

3. Apparatus as in claim 2, wherein said gripping portion further comprises a raised stud integrally formed with said handle, said raised stud extending from said gripping portion, said stud mating with securement structure on said base portion.

4. Apparatus as in claim 1, wherein said support surface of said applicator comprises a matrix of arcuate walls to which said personal hygiene or topical substance is affixed.

5. Apparatus as in claim 4, wherein said matrix of arcuate walls defines an array of narrow elongated contours, at least some of said narrow elongated contours extending at least partially around one or more of others of said narrow elongated contours, wherein each of said narrow elongated contours defines a recess defined by facing sidewalls, said facing sidewalls extending in a roughly perpendicular manner with respect to a personal hygiene or topical substance support surface, said facing sidewalls engaging said personal hygiene or topical substance.

6. Apparatus as in claim 1, wherein said gripping portion comprises:
   (d) a handle dimensioned to be grasped between the fingers and thumb of a human hand;
   (e) a mounting member coupling said handle to said base portion of said applicator; and
   (f) a living hinge member, hingedly connecting said handle to said mounting member whereby said handle is free to move angularly between a gripping position proximate the base portion and a storage position.

7. An apparatus as in claim 6, wherein said living hinge member is hingedly coupled to said handle and said mounting member connected to said base portion of said applicator, allowing said handle to move freely between a position that extends from said base and a second position adjacent to said base.

8. Apparatus as in claim 7, further comprising an enclosure for said dispensing apparatus, wherein said enclosure comprises a pair of facing plastic film portions, said facing plastic film portions being secured to each other to form a compartment.

9. Apparatus as in claim 1, wherein said protective member defines a hole through with said hygiene or topical substance is filled into said compartment.

10. Apparatus for the application of an applyable personal hygiene or topical substance to the surface of the human body comprising:

(a) an applicator comprising a base portion, said base portion having a personal hygiene or topical substance support surface;

(b) a gripping portion attached to the said base portion of said applicator, said gripping portion being separately formed from said base portion, said gripping portion being attached to said base portion;

(c) a personal hygiene or topical substance secured to the personal hygiene or topical substance support surface on said base portion of said applicator, said base portion, gripping portion and personal hygiene or topical substance forming said applicator; and (d) a protective member, detachably attached to said base portion, defining a closed compartment protecting and housing said personal hygiene or topical substance.

11. Apparatus as in claim 10, wherein said gripping portion comprises:

(e) a handle dimensioned to be grasped between the fingers and thumb of a human hand;

(f) a mounting member coupling said handle to said base portion of said applicator; and (g) a living hinge member, hingedly connecting said handle to said mounting portion whereby said handle is free to move angularly between a storage position and a gripping position.

12. Apparatus for the application of an applyable personal hygiene or topical substance to the surface of the human body comprising:

(a) an applicator comprising (i) a base portion, said base portion defining a personal hygiene or topical substance support surface and (ii) a gripping portion support surface;

(b) a gripping portion secured to said gripping portion support surface;

(c) an outer wall integrally formed with and extending from said base portion, said outer wall defining a top wall surface, said outer wall surrounding said personal hygiene or topical substance support surface;(d) a personal hygiene or topical substance secured to the personal hygiene or topical substance support surface of said base portion; and (e) a protective member, together with said base portion defining a closed compartment protecting and housing said personal hygiene or topical substance, said protective member comprising a mating sidewall integrally formed with and extending from said protective member, said mating sidewall defining a mating surface, said mating surface mating with said top surface, one of said top surface or said mating surface defining a chamfered edge which sealingly engages and mates with the other of said top surface or said mating surface.

13. Apparatus as in claim 12, wherein said protective member defines a hole for receiving the material to be applied by the apparatus, and further comprising a flat covering member adhesively attached to an outer surface of protective member and covering said hole.

14. Apparatus as in claim 13, wherein said protective member comprises an engagement structure integrally formed with said protective member, said engagement structure adapted to receive and engage mating engagement structure on said gripping portion when said gripping portion is rotated proximate to said base portion, whereby the overall size of the dispensing apparatus is reduced.

* * * * *